US011348519B2

(12) United States Patent
Nam

(10) Patent No.: US 11,348,519 B2
(45) Date of Patent: May 31, 2022

(54) DISPLAY DEVICE DISPLAYING FRAMES AT DIFFERENT DRIVING FREQUENCIES UTILIZING FIRST AND SECOND GAMMA VOLTAGE GENERATORS AND A GAP CONTROLLER

(71) Applicant: SAMSUNG DISPLAY CO., LTD., Yongin-si (KR)

(72) Inventor: Yang Uk Nam, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 5 days.

(21) Appl. No.: 17/101,285

(22) Filed: Nov. 23, 2020

(65) Prior Publication Data

US 2021/0327350 A1 Oct. 21, 2021

(30) Foreign Application Priority Data

Apr. 21, 2020 (KR) ..... 10-2020-0048133

(51) Int. Cl.
*G09G 3/3233* (2016.01)
*G09G 3/3275* (2016.01)
*G09G 3/3266* (2016.01)

(52) U.S. Cl.
CPC ..... *G09G 3/3233* (2013.01); *G09G 3/3266* (2013.01); *G09G 3/3275* (2013.01);
(Continued)

(58) Field of Classification Search
CPC ..... G09G 3/2092; G09G 3/2096; G09G 3/30; G09G 3/3233; G09G 3/325; G09G 3/3266; G09G 3/3275; G09G 3/3696; G09G 5/003; G09G 5/005; G09G 5/006; G09G 2310/027; G09G 2310/0289; G09G 2310/0291; G09G 2320/0233; G09G 2320/0247;
(Continued)

(56) References Cited

U.S. PATENT DOCUMENTS 9,761,178 B2 9/2017 Park et al.
10,157,574 B2 12/2018 Park et al.
(Continued)

FOREIGN PATENT DOCUMENTS

KR 10-2016-0050166 5/2016
KR 10-2017-0060662 8/2017
KR 10-1952939 2/2019

*Primary Examiner* — Keith L Crawley
(74) *Attorney, Agent, or Firm* — F. Chau & Associates, LLC

(57) ABSTRACT

A display device includes pixels, and a power converter configured to receive a first power voltage and an external input voltage and provide a gamma voltage to a first output terminal. The power converter includes a target power voltage generator circuit configured to generate a target power voltage, a first gamma voltage generator circuit configured to generate a first gamma voltage, a second gamma voltage generator circuit configured to generate a second gamma voltage, a first gap controller configured to generate the second gamma voltage based on the first power voltage, a reference target power voltage, and a reference gamma voltage during a period in which a display mode, and a first selector configured to selectively output the first gamma voltage or the second gamma voltage according to the display mode.

20 Claims, 16 Drawing Sheets

(52) U.S. Cl.
CPC ..... *G09G 2310/0291* (2013.01); *G09G 2320/0247* (2013.01); *G09G 2320/0276* (2013.01); *G09G 2330/023* (2013.01); *G09G 2330/028* (2013.01)

(58) Field of Classification Search
CPC ... G09G 2320/0271; G09G 2320/0276; G09G 2320/0673
See application file for complete search history.

(56) References Cited

U.S. PATENT DOCUMENTS

| | | | | |
|---|---|---|---|---|
| 2012/0069059 | A1* | 3/2012 | Lee | G09G 3/3225 345/690 |
| 2015/0103104 | A1* | 4/2015 | Lee | G09G 3/3648 345/690 |
| 2016/0117992 | A1* | 4/2016 | Park | G09G 3/3275 345/690 |
| 2017/0116922 | A1* | 4/2017 | Jung | G09G 3/3258 |
| 2017/0148390 | A1* | 5/2017 | Park | G09G 3/3225 |
| 2019/0180695 | A1* | 6/2019 | Ha | G09G 3/3266 |
| 2019/0206348 | A1* | 7/2019 | Ahn | G09G 3/3614 |
| 2020/0082781 | A1* | 3/2020 | An | G09G 3/20 |
| 2020/0160792 | A1* | 5/2020 | Park | G09G 3/3266 |
| 2020/0219450 | A1* | 7/2020 | Lee | G09G 3/325 |
| 2020/0265769 | A1* | 8/2020 | Pyo | G09G 3/2003 |
| 2021/0043132 | A1* | 2/2021 | Nam | G09G 3/3233 |
| 2021/0280121 | A1* | 9/2021 | Nam | G09G 3/2007 |

* cited by examiner

DISPLAY DEVICE DISPLAYING FRAMES AT DIFFERENT DRIVING FREQUENCIES UTILIZING FIRST AND SECOND GAMMA VOLTAGE GENERATORS AND A GAP CONTROLLER

CROSS-REFERENCE

This application claims priority under 35 U.S.C. § 119 to Korean Patent Application No. 10-2020-0048133, filed on Apr. 21, 2020, the content of which is herein incorporated by reference in its entirety.

FIELD

The disclosure generally relates to display devices, and more particularly relates to a display device with switchable modes.

DISCUSSION OF RELATED ART

As information technology is developed, display devices play an increasingly important role as connection mediums between users and information. Accordingly, use of display devices, such as a liquid crystal display device, an organic light emitting display device, and/or a plasma display device, has been increasing.

A driving frequency of pixels of the display device may vary according to a display mode. For example, in a general image display, the pixels may be driven at a relatively high frequency. In addition, in a case of a standby mode in which only minimum information (for example, a time of day) is displayed, the pixels may be driven at a relatively low frequency.

When the pixels are driven at a low frequency, various solutions have been devised to reduce power consumption of the display device. However, when these solutions are applied, a side effect may occur in which a luminance deviation is exhibited due to a rapid voltage or current change during a process of changing a driving frequency.

SUMMARY

An embodiment of the disclosure is directed to a display device that minimizes a luminance deviation that may occur when a display mode is switched.

In addition, an embodiment of the disclosure may provide a display device capable of further reducing power consumption in a low power display mode.

Embodiments of the disclosure are not limited to the above-described embodiments, and other technical changes, modifications or substitutions that are not described herein will be clearly understood by those skilled in the art from the following description.

A display device according to an embodiment of the disclosure includes pixels, a target power voltage generator circuit configured to generate a target power voltage corresponding to a first power voltage, based on an external input voltage, a first gamma voltage generator circuit configured to generate a first gamma voltage based on the external input voltage, a second gamma voltage generator circuit configured to generate a second gamma voltage based on the target power voltage, the first gamma voltage, and the first power voltage, a first gap controller configured to generate the second gamma voltage based on the first power voltage, a reference target power voltage, and a reference gamma voltage during a period in which a display mode is switched to display frames of the plurality of pixels at a different driving frequency, and a first selector configured to selectively output any one of the first gamma voltage and the second gamma voltage to a first output terminal according to the display mode.

As an embodiment, the target power voltage generator circuit may include a first amplifier including a first input terminal to which the external input voltage is input, a second input terminal to which a feedback voltage of the target power voltage is input, and an output terminal from which the target power voltage is output, and a first voltage divider circuit configured to output the feedback voltage of the target power voltage to the second input terminal of the first amplifier.

As an embodiment, the first gamma voltage generator circuit may include a second amplifier including a first input terminal to which the external input voltage is input, a second input terminal to which a feedback voltage of the first gamma voltage is input, and an output terminal from which the first gamma voltage is output, and a second voltage divider circuit configured to output the feedback voltage of the first gamma voltage to the second input terminal of the second amplifier.

As an embodiment, the second gamma voltage generator circuit may include a first resistor including a first terminal connected to an output terminal of the target power voltage generator circuit and a second terminal connected to a first node, a second resistor including a first terminal connected to the first node and a second terminal connected to the second node, a third resistor including a first terminal connected to an output terminal of the first gamma voltage generator circuit and a second terminal connected to a third node, a fourth resistor including a first terminal connected to the first power voltage and a second terminal connected to the third node, and a third amplifier including a first input terminal connected to the first node, a second input terminal connected to the third node, and an output terminal from which the second gamma voltage is output.

As an embodiment, all resistance values of the first resistor, the second resistor, the third resistor, and the fourth resistor may be the same, and the third amplifier may output the second gamma voltage based on a difference value between the first power voltage and the target power voltage, and the first gamma voltage.

As an embodiment, the third amplifier may be turned on during a period of a first display mode in which the pixels display frames at a first driving frequency, and may be turned off during a period in which the display mode is switched between a second display mode in which the pixels display frames at a second driving frequency less than the first driving frequency, and the first display mode.

As an embodiment, the third amplifier may be turned on during a period of the second display mode, or turned off during the period of the second display mode.

As an embodiment, the third amplifier may be turned off after at least one frame displayed after a period in which the display mode is switched from the first display mode to the second display mode.

As an embodiment, the first gap controller may generate the second gamma voltage based on a difference value between the reference target power voltage and the reference gamma voltage, and the first power voltage.

As an embodiment, the first gap controller may be turned off during a period of a first display mode in which the pixels display frames at a first driving frequency or during a period of a second display mode in which the pixels display frames at a second driving frequency less than the first driving frequency, and may be turned on during a period in which the display mode is switched between the first display mode and the second display mode.

As an embodiment, the first selector may receive a first selection signal instructing a first display mode displaying frames at a first driving frequency or a second selection signal instructing a second display mode displaying frames at a second driving frequency less than the first driving frequency, and when the first selector receives the first selection signal, the first selector may output the second gamma voltage to the first output terminal, and when the first selector receives the second selection signal, the first selector may output the first gamma voltage to the first output terminal.

As an embodiment, the first selector may include a multiplexer including a first input terminal connected to an output terminal of the second gamma voltage generator circuit and an output terminal of the first gap controller, a second input terminal connected to an output terminal of the first gamma voltage generator circuit, a third input terminal to which the first selection signal or the second selection signal is applied, and an output terminal from which the first gamma voltage or the second gamma voltage is output.

A display power converter according to an embodiment of the disclosure includes a first input terminal configured to receive an external input voltage; a second input terminal configured to receive a first power voltage for a plurality of pixels; a first output terminal configured to provide a gamma voltage for controlling the plurality of pixels; a target power voltage generator circuit configured to generate a target power voltage corresponding to the first power voltage based on the external input voltage; a first gamma voltage generator circuit configured to generate a first gamma voltage based on the external input voltage; a second gamma voltage generator circuit configured to generate a second gamma voltage based on the target power voltage, the first gamma voltage, and the first power voltage; a first gap controller configured to generate the second gamma voltage based on the first power voltage, a reference target power voltage, and a reference gamma voltage during a period in which a display mode is switched to display frames of the plurality of pixels at a different driving frequency; a first selector configured to selectively output any one of the first gamma voltage and the second gamma voltage to the first output terminal according to the display mode; a first reference voltage generator circuit configured to generate a first reference voltage based on the external input voltage, a second reference voltage generator circuit configured to generate a second reference voltage based on the target power voltage, the first reference voltage, and the first power voltage, a second gap controller configured to generate the second reference voltage based on the first power voltage, a reference target power voltage, and a reference voltage during a period in which the display mode is switched, and a second selector configured to selectively output any one of the first reference voltage and the second reference voltage to an second output terminal of the power converter according to the display mode.

As an embodiment, the first reference voltage generator circuit may include a fourth amplifier including a first input terminal to which the external input voltage is input, a second input terminal to which a feedback voltage of the first reference voltage is input, and an output terminal from which the first reference voltage is output, and a third voltage divider circuit configured to output the feedback voltage of the first reference voltage to the second input terminal of the fourth amplifier.

As an embodiment, the second reference voltage generator circuit may include a fifth resistor including a first terminal connected to an output terminal of the target power voltage generator circuit and a second terminal connected to a fourth node, a sixth resistor including a first terminal connected to the fourth node and a second terminal connected to a fifth node, a seventh resistor including a first terminal connected to an output terminal of the first reference voltage generator circuit and a second terminal connected to a sixth node, an eighth resistor including a first terminal connected to the first power voltage and a second terminal connected to the sixth node, and a fifth amplifier including a first input terminal connected to the fourth node, a second input terminal connected to the sixth node, and an output terminal from which the second reference voltage is output.

As an embodiment, all resistance values of the fifth resistor, the sixth resistor, the seventh resistor, and the eighth resistor may be the same, and the fifth amplifier may output the second reference voltage based on a difference value between the first power voltage and the target power voltage, and the first reference voltage.

As an embodiment, the fifth amplifier may be turned on during a period of a first display mode in which the pixels display frames at a first driving frequency, and may be turned off during a period in which the display mode is switched between a second display mode in which the pixels display frames at a second driving frequency less than the first driving frequency, and the first display mode.

As an embodiment, the fifth amplifier may be turned on during a period of the second display mode, or turned off during the period of the second display mode.

As an embodiment, the second gap controller may generate the second reference voltage based on a difference value between the reference target power voltage and the reference voltage, and the first power voltage.

As an embodiment, the second gap controller may be turned off during a period of a first display mode in which the pixels display frames at a first driving frequency or during a period of a second display mode in which the pixels display frames at a second driving frequency less than the first driving frequency, and may be turned on during a period in which the display mode is switched between the first display mode and the second display mode.

Specific details of other embodiments are included in the detailed description and drawings.

As described above, embodiments of the disclosure may provide a display device that minimizes luminance deviation that may occur when the display mode is switched.

In addition, embodiments of the disclosure may provide a display device capable of further reducing power consumption in a low power display mode.

Effects according to embodiments are not limited by the details illustrated, and various alternate effects are included in the present specification.

BRIEF DESCRIPTION OF THE DRAWINGS

The above and other embodiments of the disclosure will become more apparent by describing in further detail embodiments thereof with reference to the accompanying drawings, in which.

DETAILED DESCRIPTION

Figure 1:
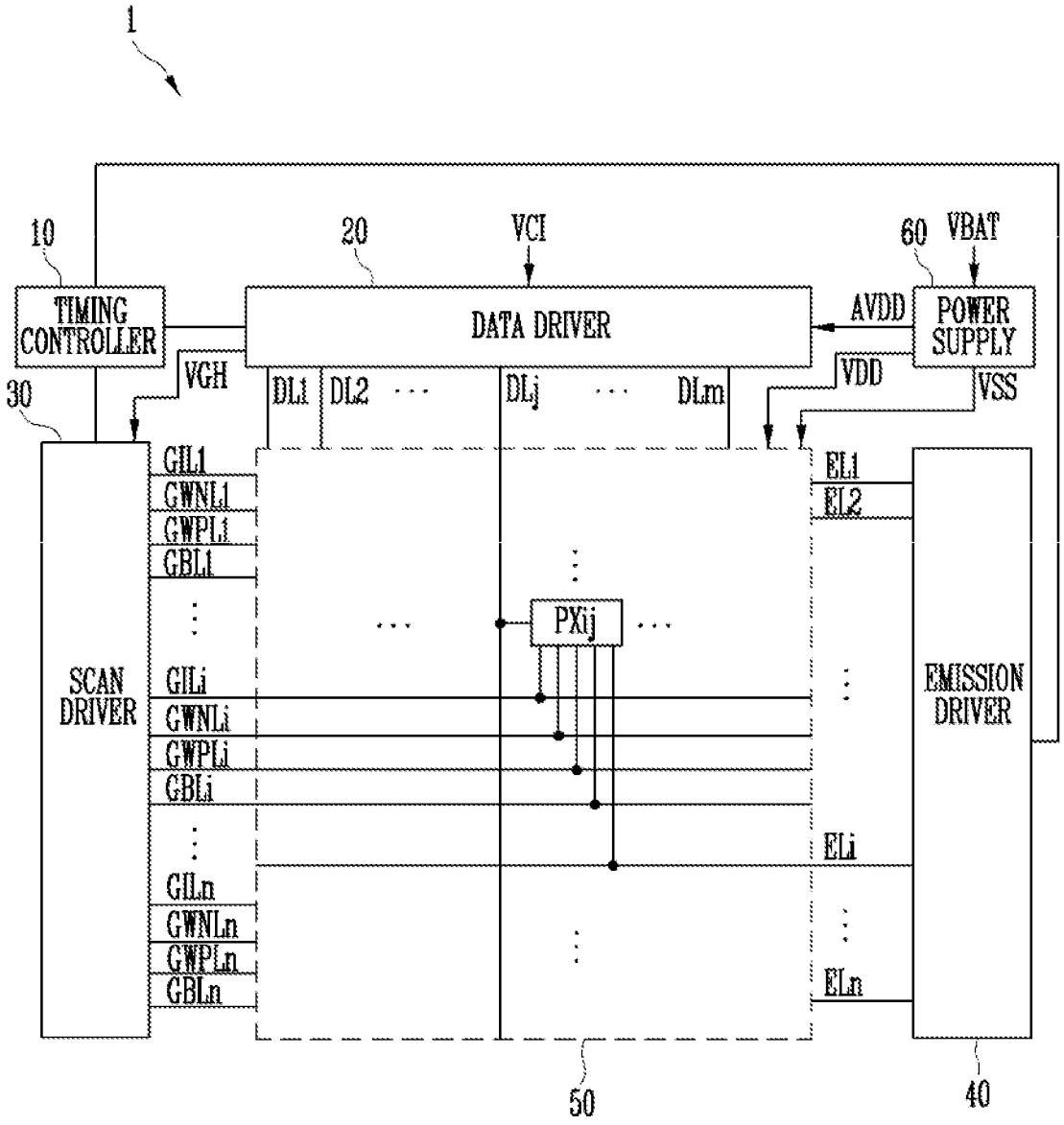
FIG. 1 is a block diagram for describing a display device according to an embodiment of the disclosure.

Exemplary embodiments of the disclosure and methods of operation will become apparent with reference to the embodiments described in detail below when taken together with the accompanying drawings. However, the disclosure is not limited to the embodiments disclosed below, and may be implemented in various different forms. The present embodiments are provided as examples so that the disclosure will be thorough and complete and those skilled in the art to which the disclosure pertains can fully understand the scope of the disclosure. The scope of the disclosure is bounded only by the scope of the appended claims.

In adding reference numerals to components of each drawing, the same or similar components may have the same or similar reference numerals as much as possible even though the same or similar components are shown in different drawings. In addition, in describing the disclosure, when it is determined that the detailed description of the related configuration or function may obscure the gist of the disclosure, duplicate detailed description thereof may be omitted.

In describing the components of the disclosure, terms of first, second, and the like may be used. These terms are only to distinguish the components from other components, and nature, turn, sequence, number, or the like of the corresponding components is not limited by the terms thereof. In a case where a component is described as being "connected" or "coupled" to another component, the component may be directly connected to or coupled to the other component. However, it will be understood that another component may be "interposed" between each component or each component may be "connected" or "coupled" through another component. A singular form includes a plural form unless the context clearly indicates otherwise.

FIG. 1 is a diagram for describing a display device according to an embodiment of the disclosure.

Referring to FIG. 1, the display device 1 may include a timing controller 10, a data driver 20, a scan driver 30, an emission driver 40, a display unit 50, and a power supply 60.

The timing controller 10 may generate signals used for the display device 1 by receiving an external input signal for each of image frames from an external processor. For example, the timing controller 10 may provide grayscale values and control signals to the data driver 20. In addition, the timing controller 10 may provide a clock signal, a scan start signal, and the like to the scan driver 30. In addition, the timing controller 10 may provide a clock signal, a light emission stop signal, and the like to the emission driver 40.

The timing controller 10 may render the grayscale values to correspond to a specification of the display device 1. For example, the external processor may provide a red grayscale value, a green grayscale value, and a blue grayscale value for each unit dot. However, when the display unit 50 has a Pentile® structure, since an adjacent unit dot may share a pixel, the pixel need not correspond to each grayscale value one-to-one basis, and rendering of the grayscale values is used. When the pixel corresponds to each grayscale value on one-to-one basis, rendering of the grayscale values may be unnecessary. The rendered or non-rendered grayscale values may be provided to the data driver 20. The timing controller 10 may provide control signals suitable for each specification to the data driver 20 and the scan driver 30 for frame display.

The power supply 60 may receive a first external input voltage VBAT and convert the first external input voltage VBAT to provide a data driving voltage AVDD to the data driver 20. For example, the power supply 60 may receive the first external input voltage VBAT from a battery or the like, and boost the first external input voltage VBAT to generate the data driving voltage AVDD that is a voltage higher than the first external input voltage VBAT.

The power supply 60 may receive the first external input voltage VBAT and convert the first external input voltage VBAT to provide a first power voltage VDD and a second power voltage VSS to the display unit 50. For example, when the display device 1 operates in a first display mode as described below with reference to FIGS. 3 and 4, the power supply 60 may provide the first power voltage VDD and the second power voltage VSS to the display unit 50. Here, the first power voltage VDD and the second power voltage VSS may mean driving voltages used for pixels PXij included in the display unit 50 to emit light.

The power supply 60 may be configured of, for example, a power management integrated chip (PMIC). The power supply 60 may be configured of, for example, an external DC/DC IC.

The data driver 20 may generate data voltages to be provided to data lines DL1, DL2, . . . . DLj . . . and DLm using the grayscale values and the control signals received from the timing controller 10. For example, the data driver 20 may sample the grayscale values by using a clock signal, and may apply the data voltages corresponding to the grayscale values to the data lines DL1, DL2, DLj, and DLm in a unit of a pixel row (for example, pixels connected to the same scan line). Here, m and j may be natural numbers.

The data driver 20 may receive the data driving voltage AVDD from the power supply 60 and generate a scan driving voltage VGH used for controlling the display unit 50 by using the data driving voltage AVDD.

The data driver 20 may receive a second external input voltage VCI, and may generate a gamma voltage and a reference voltage used for controlling the display unit 50 based on the second external input voltage VCI. This will be described later with reference to FIGS. 7 to 14.

The data driver 20 may be configured of, for example, an independent IC. As another example, the data driver 20 may be configured of an IC integrated with the timing controller 10.

When the display device 1 operates in a second display mode as described later with reference to FIGS. 5 and 6, the data driver 20 may receive the data driving voltage AVDD and convert the data driving voltage AVDD to provide the first power voltage VDD and the second power voltage VSS to the display unit 50 instead of the power supply 60. At this time, the power voltages provided by the data driver 20 may be the same as or less than the power voltages provided by the power supply 60.

The scan driver 30 may receive the clock signal, the scan start signal, and the like from the timing controller 10 to generate scan signals to be provided to scan lines GIL1, GWNL1, GWPL1, GBL1, . . . . GILi, GWNLi, GWPLi, GBLi, . . . . GILn, GWNLn, GWPLn, and GBLn. Here, n and I may be natural numbers.

The scan driver 30 may include a plurality of sub-scan drivers. For example, a first sub-scan driver may provide scan signals for scan lines GIL1, GIL1*i*, and GILn, a second sub-scan driver may provide scan signals for scan lines GWNL1, GWNLi, and GWNLn, a third sub-scan driver may provide scan signals for scan lines GWPL1, GWPLi, GWPLn, and a fourth sub-scan driver may provide scan signals for scan lines GBL1, GBLi, and GBLn. Each of the sub-scan drivers may include a plurality of scan stages connected in a form of a shift register. For example, the scan signals may be generated in a method of sequentially transferring a pulse of a turn-on level of the scan start signal supplied to a scan start line to a next scan stage.

For another example, a first sub-scan driver and a second sub-scan driver may be integrated to provide the scan signals for the scan lines GIL1, GWNL1, GILi, GWNLi, GILn, and GWNLn, and a third sub-scan driver and a fourth sub-scan driver may be integrated to provide the scan signals for the scan lines GWPL1, GBL1, GWPLi, GBLi, GWPLn, and GBLn. For example, a previous scan line of an n-th scan line GWNLn, that is, an (n−1)-th scan line may be connected to the same electrical node as an n-th scan line GILi. In addition, for example, a next scan line of an n-th scan line GWPLn, that is, an (n+1)-th scan line may be connected to the same electrical node as an n-th scan line GBLn.

At this time, the first sub-scan driver and the second sub-scan driver may supply scan signals having pulses of a first polarity to the scan lines GIL1, GWNL1, GILi, GWNLi, GILn, and GWNLn. In addition, the third sub-scan driver and the fourth sub-scan driver may supply scan signals having pulses of a second polarity to the scan lines GWPL1, GBL1, GWPLi, GBLi, GWPLn, and GBLn. The first polarity and the second polarity may be opposite polarities.

Hereinafter, the polarity may mean a logic level of a pulse. For example, when the pulse is the first polarity, the pulse may have a high level. At this time, the pulse of the high level may be referred to as a rising pulse. When the rising pulse is supplied to a gate electrode of an N-type transistor, the N-type transistor may be turned on. That is, the rising pulse may be a turn-on level with respect to the N-type transistor. Here, it is assumed that a voltage of a sufficiently low level is applied to a source electrode of the N-type transistor compared to the gate electrode. For example, the N-type transistor may be an N-type metal-oxide semiconductor (NMOS).

In addition, when the pulse is the second polarity, the pulse may have a low level. At this time, the pulse of the low level may be referred to as a falling pulse. When the falling pulse is supplied to a gate electrode of a P-type transistor, the P-type transistor may be turned on. That is, the falling pulse may be a turn-on level with respect to the P-type transistor. Here, it is assumed that a voltage of a sufficiently high level is applied to a source electrode of the P-type transistor compared to the gate electrode. For example, the P-type transistor may be a P-type metal-oxide semiconductor (PMOS).

The scan driver 30 may generate the scan signals using a scan driving voltage VGH. For example, scan signals of a high level may be configured of the scan driving voltage VGH. That is, a case where the scan driving voltage VGH is output from a scan stage may be expressed as outputting the scan signal of the high level. For another example, the scan stage does not directly output the scan driving voltage VGH, and may use the scan driving voltage VGH as an internal control voltage.

The emission driver 40 may receive the clock signal, the light emission stop signal, and the like from the timing controller 10 to generate light emission signals to be provided to light emission lines EL1, EL2, . . . . ELi, . . . and ELn. For example, the emission driver 40 may sequentially provide light emission signals having a pulse of a turn-off level to the light emission lines EL1, EL2, and ELn. For example, the emission driver 40 may be configured in a form of a shift register, and may generate the light emission signals in a method of sequentially transferring a pulse of a turn-off level of the light emission stop signal to a next light emission stage under control of the clock signal.

The display unit 50 includes pixels PXij. For example, the pixel PXij may be connected to corresponding data line DLj, scan lines GILi, GWNLi, GWPLi, and GBLi, and light emission line ELi.

Figure 2:
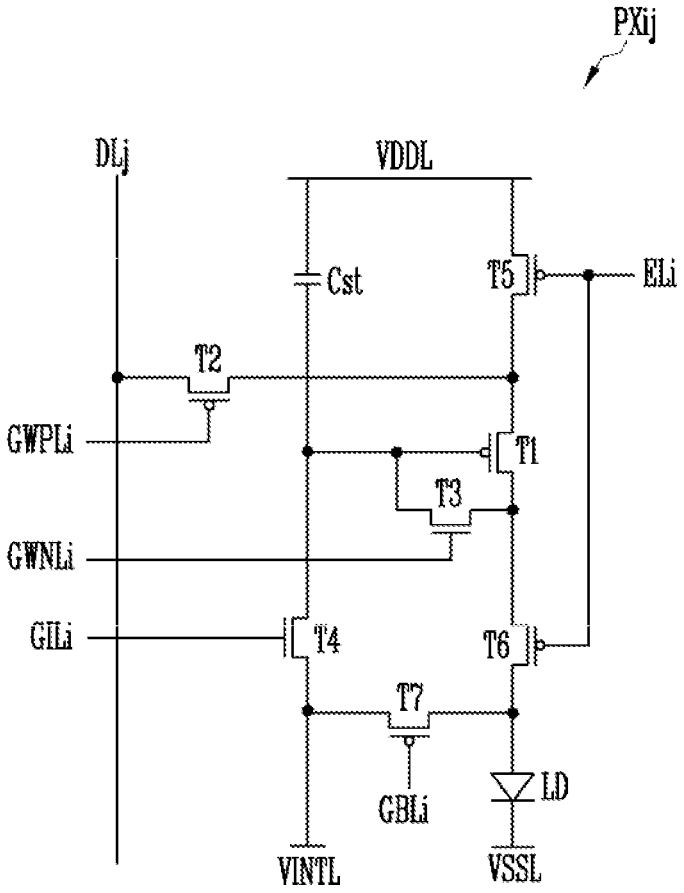
FIG. 2 is a circuit diagram for describing a pixel according to an embodiment of the disclosure.

FIG. 2 is a diagram for describing a pixel according to an embodiment of the disclosure.

Referring to FIG. 2, the pixel PXij according to an embodiment of the disclosure includes transistors T1, T2, T3, T4, T5, T6, and T7, a storage capacitor Cst, and a light-emitting diode LD.

The first transistor T1 may be referred to as a driving transistor. A first electrode of the first transistor T1 may be connected to a first electrode of the second transistor T2, a second electrode of the first transistor T1 may be connected to a first electrode of the third transistor T3, and a gate electrode of the first transistor T1 may be connected to a second electrode of the third transistor T3.

The second transistor T2 may be referred to as a scan transistor. The first electrode of the second transistor T2 may be connected to the first electrode of the first transistor T1, a second electrode of the second transistor T2 may be connected to the data line DLj, and a gate electrode of the second transistor T2 may be connected to the scan line GWPLi.

The third transistor T3 may be referred to as a diode connection transistor. The first electrode of the third transistor T3 may be connected to the second electrode of the first transistor T1, the second electrode of the third transistor T3 may be connected to the gate electrode of the first transistor T1, and a gate electrode of the third transistor T3 may be connected to the scan line GWNLi.

The fourth transistor T4 may be referred to as a gate initialization transistor. A first electrode of the fourth transistor T4 may be connected to a second electrode of the capacitor Cst, a second electrode of the fourth transistor T4 may be connected to an initialization line VINTL, and a gate electrode of the fourth transistor T4 may be connected to the scan line GILi.

The fifth transistor T5 may be referred to as a first light emission transistor. A first electrode of the fifth transistor T5 may be connected to a first power line VDDL, a second electrode of the fifth transistor T5 may be connected to the first electrode of the first transistor T1, and a gate electrode of the fifth transistor T5 may be connected to the light emission line ELi.

The sixth transistor T6 may be referred to as a second light emission transistor. A first electrode of the sixth transistor T6 may be connected to the second electrode of the first transistor T1, a second electrode of the sixth transistor T6 may be connected to an anode of the light-emitting diode LD, and a gate electrode of the sixth transistor T6 may be connected to the light emission line ELi. Although a light-emitting diode is shown here as an exemplary emission element, it shall be understood that any emission element may be used in alternate embodiments.

The seventh transistor T7 may be referred to as an anode initialization transistor. A first electrode of the seventh transistor T7 may be connected to the anode of the light emitting diode LD, a second electrode of the seventh transistor T7 may be connected to the initialization line VINTL, and a gate of the seventh transistor T7 may be connected to the scan line GBLi.

The storage capacitor Cst may charge an electric charge corresponding to a difference between voltages respectively applied to two electrodes or discharge an already charged electric charge. A first electrode of the storage capacitor Cst may be connected to the first power line VDDL, and a second electrode of the storage capacitor Cst may be connected to the gate electrode of the first transistor T1.

The anode of the light emitting diode LD may be connected to the second electrode of the sixth transistor T6 and a cathode of the light emitting diode LD may be connected to a second power line VSSL. A voltage applied to the second power line VSSL may be set to be lower than a voltage applied to the first power line VSDL. The light emitting diode LD may be an organic light emitting diode, an inorganic light emitting diode, a quantum dot light emitting diode, or the like.

The transistors T1, T2, T5, T6, and T7 may be P-type transistors. The P-type transistor collectively refers to a transistor in which a current amount conducted increases when a voltage difference between a gate electrode and a source electrode increases in a negative direction. Channels of the transistors T1, T2, T5, T6, and T7 may be configured of poly silicon. The poly silicon transistor may be a low temperature poly silicon (LTPS) transistor. The poly silicon transistor has high electron mobility, and thus has a fast driving characteristic. However, the disclosure is not limited thereto, and according to an embodiment, the transistors T1, T2, T5, T6, and T7 may be N-type oxide semiconductor transistors, for example, rather than the P-type poly silicon transistors.

The transistors T3 and T4 may be N-type transistors. The N-type transistor collectively refers to a transistor in which a current amount conducted increases when a voltage difference between a gate electrode and a source electrode increases in a positive direction. Channels of the transistors T3 and T4 may be configured of an oxide semiconductor. The oxide semiconductor transistor may be processed at a low temperature and has low charge mobility compared to the poly silicon. Therefore, the oxide semiconductor transistors have a small leakage current amount generated in a turn-off state compared to the poly silicon transistors. However, the disclosure is not limited thereto, and according to an embodiment, the transistors T3 and T4 may be P-type poly silicon transistors rather than the oxide semiconductor transistors.

According to an embodiment, the seventh transistor T7 may be configured of an N-type oxide semiconductor transistor rather than the poly silicon transistor. At this time, one of the scan lines GWNLn and GILn may be connected to the gate electrode of the seventh transistor T7 by replacing the scan line GBLn.

The transistors T1, T2, T3, T4, T5, T6, and T7 may be configured in various forms, such as a thin film transistor (TFT), a field effect transistor (FET), and/or a bipolar junction transistor (BJT).

A display pixel PXij according to an embodiment of the disclosure includes a first transistor T1 having a first connection terminal coupled to a supply voltage line VDDL, a control terminal coupled to a storage capacitor Cst, and a second connection terminal coupled to an emission device LD; a second transistor T2 having a first connection terminal coupled to a data line DLj, a control terminal coupled to a first scan line GWPLi, and a second connection terminal coupled to the first connection terminal of the first transistor T1; and a third transistor T3 having a first connection terminal coupled to the control terminal of the first transistor T1, and a control terminal coupled to a display-mode-dependent second scan line GWNLi.

Figure 3:
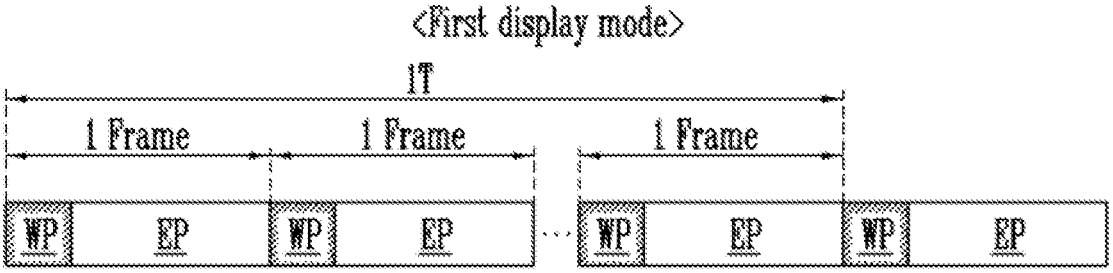
FIG. 3 is a timing diagram for describing an embodiment in which the pixel is driven according to a first driving frequency.
Figure 4:
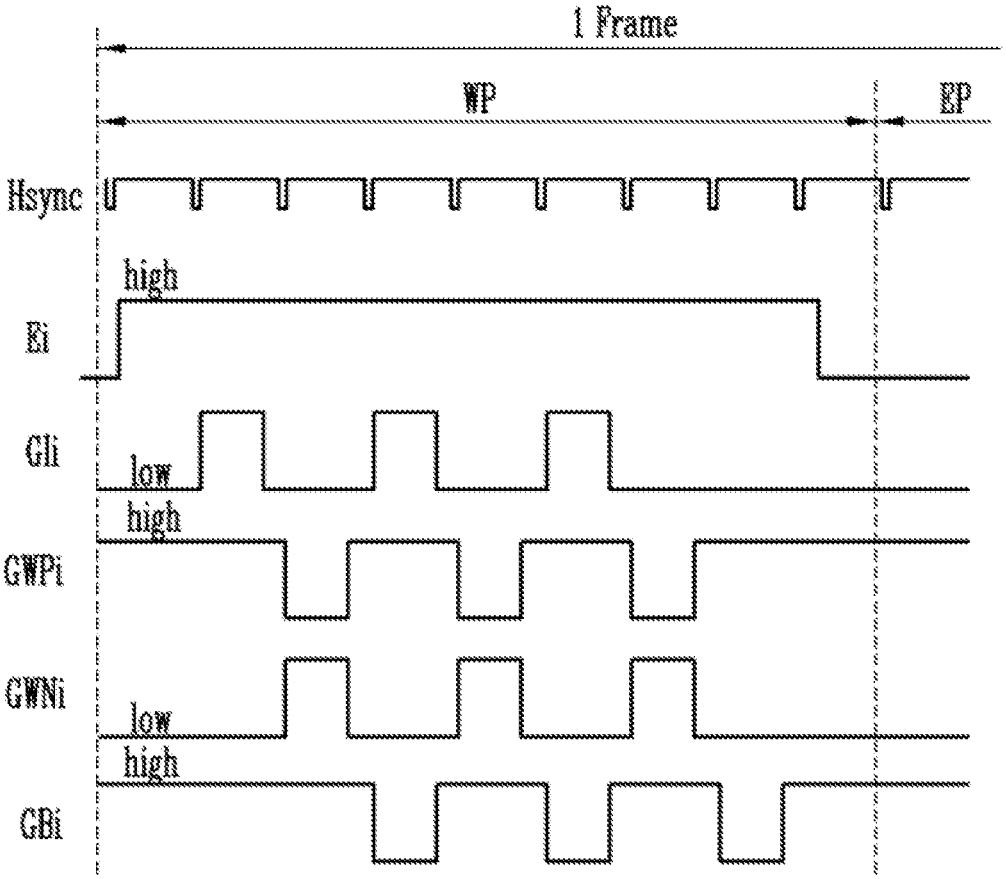
FIG. 4 is a timing diagram for describing a data writing period of the pixel according to an embodiment of the disclosure.
Figure 5:
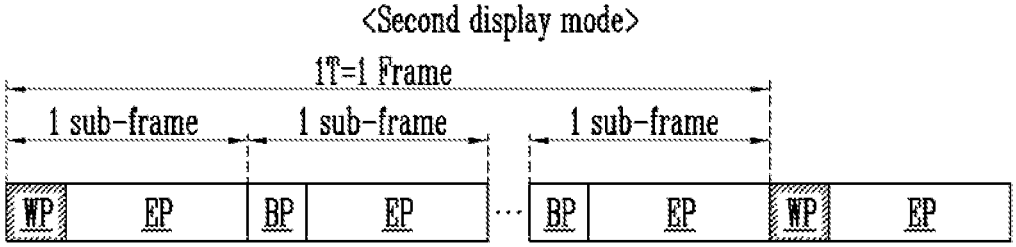
FIG. 5 is a timing diagram for describing an embodiment in which the pixel is driven according to a second driving frequency.
Figure 6:
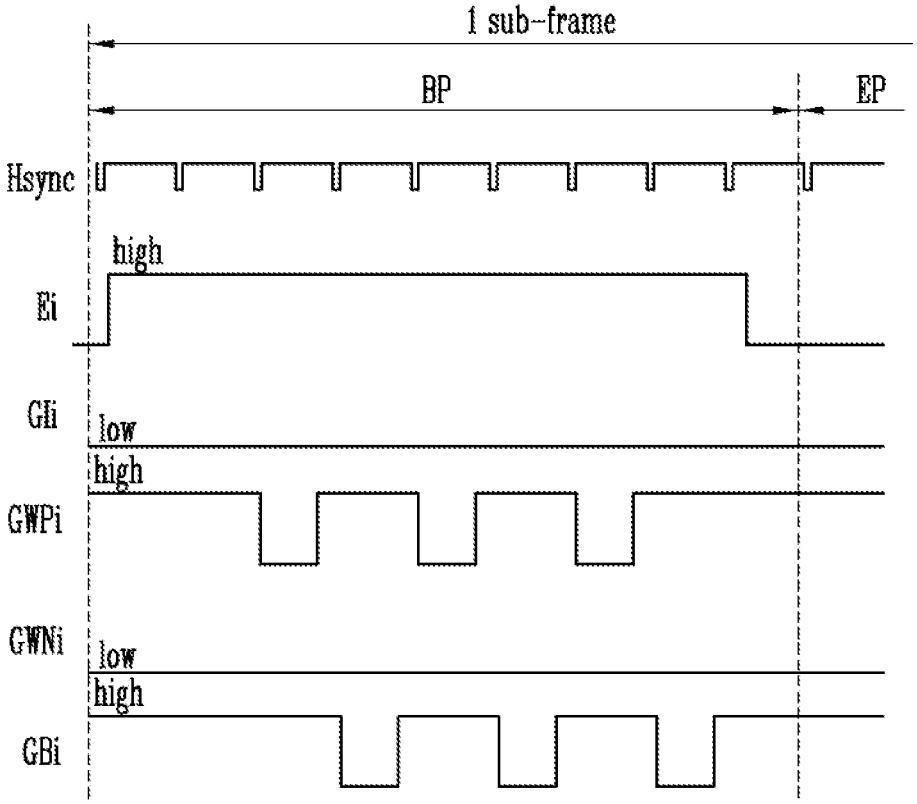
FIG. 6 is a timing diagram for describing a bias period of the pixel according to an embodiment of the disclosure.

That is, comparing the first display mode of FIGS. 3 and 4 with the second display mode of FIGS. 5 and 6, the scan line scan line GWNLi carries a signal GWNi that is dependent upon the display mode. Moreover, the scan line scan line GILi carries a signal Gli that is dependent upon the display mode.

The third transistor T3 may have a second connection terminal coupled to the second connection terminal of the first transistor T1. The display pixel PXij may have a fourth transistor T4 having its control terminal coupled to a display-mode-dependent third scan line GILi and a second connection terminal coupled to an intermediate voltage line VINTL. The display pixel PXij may have a fifth transistor T5 having a first connection terminal coupled to the supply voltage line VDDL, a control terminal coupled to an emission line ELi, and a second connection terminal coupled to the first connection terminal of the first transistor T1. The display pixel PXij may have a sixth transistor T6 having a first connection terminal coupled to the second connection terminal of the first transistor T1, a control terminal coupled to an emission line ELi, and a second connection terminal coupled to the emission device LD, The display pixel PXij may have a fourth transistor T4 having its control terminal coupled to a display-mode-dependent third scan line GILi and a second connection terminal coupled to an intermediate voltage line VINTL; and a seventh transistor T7 having a first connection terminal coupled to the second connection terminal of the fourth transistor T4, a control terminal coupled to a fourth scan line GBLi, and a second connection terminal coupled to the second connection terminal of the sixth transistor T6.

FIG. 3 is a diagram for describing an embodiment in which the pixel is driven according to a first driving frequency.

When the display unit 50 displays frames at the first driving frequency, the display device 1 may be in a first display mode. In addition, when the display unit 50 displays the frames at a second driving frequency less than the first driving frequency, the display device 1 may be in a second display mode.

In the first display mode, the display device 1 may display image frames at 20 Hz or more, for example, 60 Hz. In this case, the power supply 60 may provide a first power voltage VDD and a second power voltage VSS to the display unit 50.

The second display mode may be a low power display mode or a standby mode. For example, in the standby mode, the image frames may be displayed at less than 20 Hz, for example, 1 Hz. For example, a case where only a time and a date are displayed in "always on display mode" among common modes may correspond to the second display mode. In this case, in order to reduce power consumption, the data driver 20 may provide the first power voltage VDD and the second power voltage VSS to the display unit 50 instead of the power supply 60.

In the first display mode, one period 1T may include a plurality of image frames. The one period 1T may be an arbitrarily defined period, and is a period defined for comparison with the second display mode. The one period 1T may mean the same time interval in the first display mode and the second display mode.

In the first display mode, each of the image frames may include a data writing period WP and a light emitting period EP.

Hereinafter, a method of driving the pixel PXij for any one image frame in the one period 1T will be described with reference to FIG. 4. Since the same driving method may be applied to other image frames within the one period 1T, repetitive description will be omitted.

FIG. 4 is a diagram for describing the data writing period of the pixel according to an embodiment of the disclosure.

As described above, one image frame in the first display mode may include the data writing period WP and the light emitting period EP. However, since the data writing period WP and the light emitting period EP of the present embodiment are for a specific pixel PXij or a specific pixel row, such as pixels connected to the same scan line, a writing period and a light emitting period of another pixel connected to another scan line may be different from those of the pixel PXij.

First, a light emission signal Ei of a turn-off level (e.g., a high level) may be supplied to the light emission line ELi during the data writing period WP. Therefore, the fifth transistor T5 and the sixth transistors T6 may be turned off during the data writing period WP.

First, a signal Gli having a first pulse of a turn-on level (e.g., a high level) is supplied to the scan line GILi. Accordingly, the fourth transistor T4 is turned on, and the gate electrode of the first transistor T1 and the initialization line VINTL are connected to each other. Accordingly, a voltage of the gate electrode of the first transistor T1 is initialized to an initialization voltage of the initialization line VINTL, and is maintained by the storage capacitor Cst. For example, the initialization voltage of the initialization line VINTL may be a voltage sufficiently lower than the first power voltage VDD of the first power line VDDL. For example, the initialization voltage may be a voltage of a level similar to that of the second power voltage VSS of the second power line VSSL.

Next, signals GWPi and GWNi having the first pulses of the turn-on level are supplied to the scan lines GWPLi and GWNLi, respectively, and the corresponding second transistor T2 and third transistor T3 are turned on. Accordingly, the data voltage applied to the data line DLj is written to the storage capacitor Cst through the second transistor T2, the first transistor T1, and the third transistors T3. However, the data voltage at this time is a data voltage of a previous-previous pixel, is not for light emission of the pixel PXij, and is for applying an on-bias voltage to the first transistor T1. When the on-bias voltage is applied before an actual data voltage is written to the first transistor T1, an improvement for a hysteresis phenomenon is possible.

Next, a signal GBi having the first pulse of the turn-on level (e.g., a low level) is supplied to the scan line GBLi, and the seventh transistor T7 is turned on. Therefore, a voltage applied to the anode of the light emitting diode LD is initialized.

At this time, a signal Gli having a second pulse of the turn-on level (e.g., a high level) is supplied to the scan line GILT and the above-described driving process is performed again. That is, the on-bias voltage is applied to the first transistor T1 once again, and the voltage applied to the anode of the light emitting diode LD is initialized.

By repeating the above-described process, when the signals GWPi and GWNi having third pulses of the turn-on level are supplied to the scan lines GWPLi and GWNLi, respectively, the data voltage of the pixel PXij is written to the storage capacitor Cst. At this time, the data voltage written to the storage capacitor Cst is a voltage reflecting a decrease of a threshold voltage of the first transistor T1.

Finally, when the light emission signal Ei becomes a turn-on level (e.g., a low level), the fifth transistor T5 and the sixth transistor T6 are turned on. Accordingly, a driving current path connected to the first power line VDDL, the fifth transistor T5, the first transistor T1, the sixth transistor T6, the light emitting diode LD, and the second power line VSSL is formed, and a driving current then flows. A driving current amount corresponds to the data voltage stored in the storage capacitor Cst. Specifically, the driving current may be proportional to a square of a difference value between the first power voltage VDD and the data voltage, and the data voltage may be determined by a gamma voltage and/or a reference voltage. Since the driving current flows through the first transistor T1, a decrease of a threshold voltage of the first transistor T1 is reflected. Accordingly, since the decrease of the threshold voltage reflected in the data voltage stored in the storage capacitor Cst and the decrease of the threshold voltage reflected in the driving current are offset each other, he driving current corresponding to the data voltage may flow regardless of the threshold voltage value of the first transistor T1.

According to the driving current amount, the light emitting diode LD emits light at a targeted luminance.

In the present embodiment, each of the scan signal includes three pulses, but in other embodiments, each of the scan signals may include two or four or more pulses. In still another embodiment, each of the scan signals may be configured to include one pulse. In this case, a process of applying an on-bias voltage to the first transistor T1 is omitted.

FIG. 5 is a diagram for describing an embodiment in which the pixel is driven according to the second driving frequency.

In the second display mode, one sub-frame in one period 1T includes a data writing period WP and a light emitting period EP, and each of other sub-frames in the one period 1T includes a bias period BP and the light emitting period EP.

Since the third transistor T3 and the fourth transistor T4 of the pixel PXij maintain a turn-off state in the other sub-frames during the one period 1T, the storage capacitor Cst maintains the same data voltage during a plurality of sub-frames. In particular, since the third transistor T3 and the fourth transistor T4 may be configured of oxide semiconductor transistors, a leakage current may be minimized.

Therefore, the pixel PXij may display the same image during the one period 1T based on the data voltage supplied during the data writing period WP of one image frame 1 FRAME during the one period 1T.

FIG. 6 is a diagram for describing the bias period of the pixel according to an embodiment of the disclosure.

Referring to FIG. 6, in the bias period BP, scan signals Gli and GWNi of a turn-off level (e.g., a low level) are supplied. Therefore, as described above, in the bias period BP, the data voltage written to the storage capacitor Cst is not changed.

However, in the bias period BP and the data writing period WP, the same light emission signal Ei and scan signals GWPi and GBi are supplied. At this time, a reference data voltage may be applied to the data line DLj. This is for causing a light emission waveform of the light emitting diode LD to be similar to each other between a plurality of sub-frames of the one period 1T so that flicker is not to recognized to the user during a low frequency driving.

The pixel PXij described with reference to FIGS. 1 to 6 is one embodiment suitable for high frequency driving and low frequency driving. The embodiments described below may also be applied to a pixel having another circuit capable of the high frequency driving and the low frequency driving. For example, all transistors of the pixel may be configured of only P-type transistors. In this case, since the scan driver may include only a sub-scan driver for the P-type transistors, a configuration of the scan driver may be simplified. For example, the transistors of the pixel need not include light emission transistors. In this case, the emission driver may be unnecessary.

Figure 7:
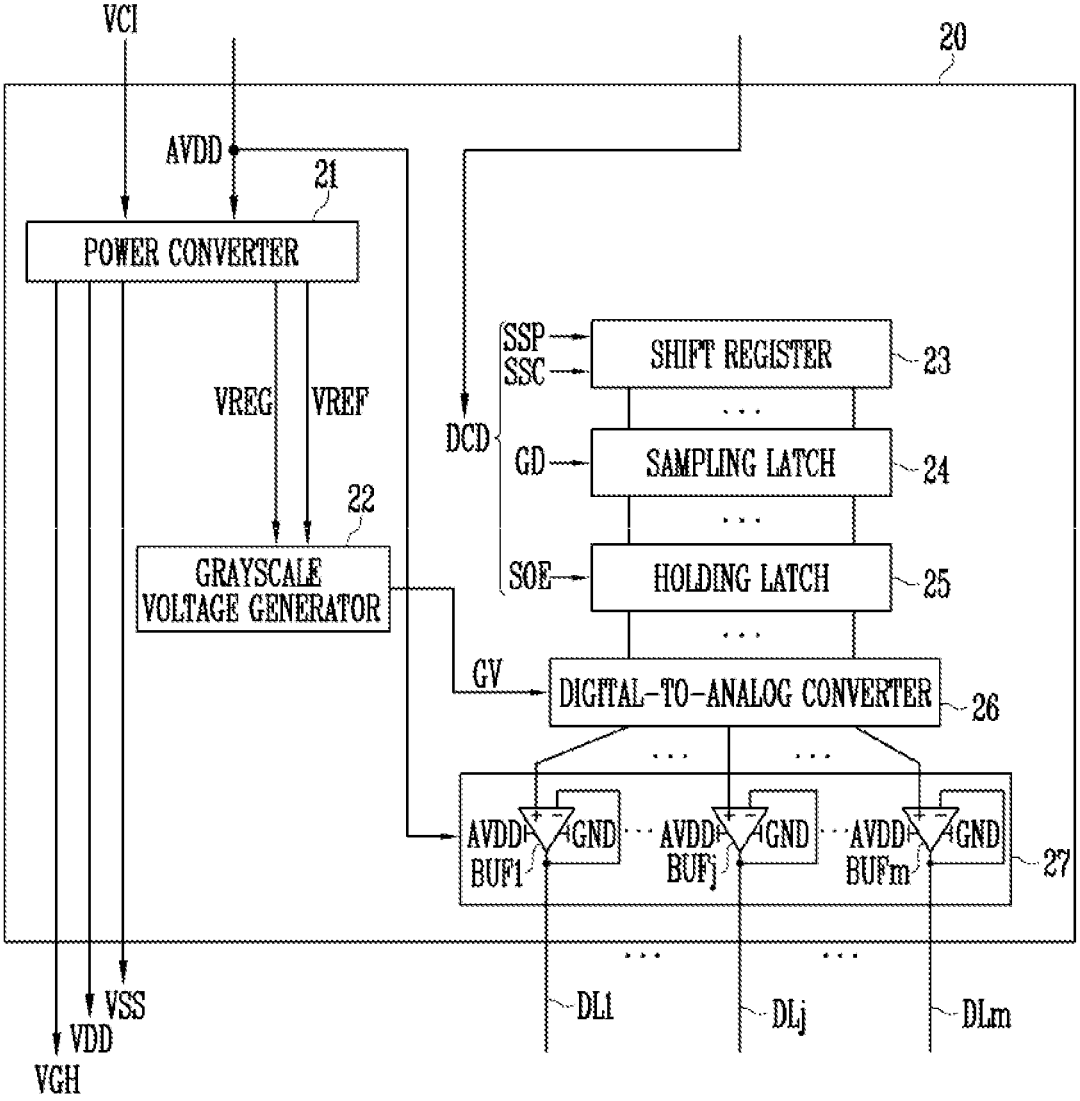
FIG. 7 is a block diagram for describing a data driver according to an embodiment of the disclosure.

FIG. 7 is a diagram for describing the data driver according to an embodiment of the disclosure.

Referring to FIG. 7, the data driver 20 according to an embodiment of the disclosure may include a power converter 21, a grayscale voltage generator 22, a shift register 23, a sampling latch 24, a holding latch 25, a digital-to-analog converter 26, and an output buffer 27.

The power converter 21 may receive the data driving voltage AVDD and convert the data driving voltage AVDD to provide the scan driving voltage VGH used for control of the pixels PXij to an output terminal. The scan driving voltage VGH may be provided to the scan driver 30.

In an embodiment, when the display device 1 operates in the second display mode, the power converter 21 may receive the data driving voltage AVDD and convert the data driving voltage AVDD to generate the first power voltage VDD and a second power voltage VSS'. At this time, the first power voltage VDD and the second power voltage VSS' may be provided to the display unit 50 by the power converter 21. In addition, the first power voltage VDD may be fed back to the power converter 21.

The power converter 21 may receive the first power voltage VDD and a second external input voltage VCI, and provide a gamma voltage VREG used for the control of the pixels PXij to the output terminal, based on the first power voltage VDD and the second external input voltage VCI. The gamma voltage VREG may be provided to the grayscale voltage generator 22.

Here, a magnitude of the gamma voltage VREG may vary according to a display mode (for example, the first display mode and the second display mode). For example, the gamma voltage of the first display mode may be greater than the gamma voltage of the second display mode.

The power converter 21 may receive the first power voltage VDD and the second external input voltage VCI, and provide a reference voltage VREF used for the control of the pixels PXij to the output terminal, based on the first power voltage VDD and the second external input voltage VCI. The reference voltage VREF may be provided to the grayscale voltage generator 22.

Here, a magnitude of the reference voltage VREF may vary according to the display mode (for example, the first display mode and the second display mode).

The grayscale voltage generator 22 may generate grayscale voltages GV using the gamma voltage VREG. Since the grayscale voltages GV generated by the grayscale voltage generator 22 are used for display of the image frame, it is necessary to provide grayscale voltages GV corresponding to a color of the pixels. Therefore, the grayscale voltage generator 22 may include a first color grayscale voltage generator, a second color grayscale voltage generator, and a third color grayscale voltage generator. Here, for example, a first color may be red, a second color may be green, and a third color may be blue.

A data signal DCD received from the timing controller 10 may include a source start pulse SSP, a source shift clock SSC, grayscale values GD, a source output enable signal SOE, and the like.

The shift register 23 may sequentially generate sampling signals while shifting the source start pulse SSP every one period 1T of the source shift clock SSC. The number of sampling signals may correspond to the number of data lines DL1, DLj, and DLm. For example, the number of sampling signals may be the same as the number of data lines DL1, DLj, and DLm. For another example, when the display device 1 further includes a de-multiplexer between the data driver 20 and the data lines DL1, DLj, and DLm, the number of sampling signals may be less than the number of data lines DL1, DLj, and DLm. For convenience of description, it is assumed below that there is no de-multiplexer.

The sampling latch 24 may include the number of sampling latch units corresponding to the number of data lines DL1, DLj, and DLm, and sequentially receive the grayscale values GD for the image frame from the timing controller 10. The sampling latch 24 may store the grayscale values GD sequentially received from the timing controller 10 in corresponding sampling latch units, in response to the sampling signals sequentially supplied from the shift register 23.

The holding latch 25 may include the number of holding latch units corresponding to the number of data lines DL1, DLj, and DLm. The holding latch 25 may store the grayscale values GD, which are stored in the sampling latch units, in the holding latch units, when the source output enable signal SOE is input.

The digital-to-analog converter 26 may include the number of digital-to-analog conversion units corresponding to the number of data lines DL1, DLj, and DLm. For example, the number of digital-to-analog conversion units may be the same as the number of data lines DL1, DLj, and DLm. Each of the digital-to-analog conversion units may apply a grayscale voltage GV corresponding to the grayscale value GD stored in a corresponding holding latch to a corresponding data line.

The output buffer 27 may include buffer units BUF1 and BUFm. For example, each of the buffer units BUF1 and BUFm may be an operational amplifier. Each of the buffer units BUF1 and BUFm may be configured in a voltage follower form to apply an output of the digital-to-analog conversion unit to a corresponding data line. For example, an inverted terminal of each of the buffer units BUF1 and BUFm may be connected to output terminals thereof, and a non-inverted terminal may be connected to an output terminal of the digital-to-analog conversion unit. Outputs of the buffer units BUF1, BUFj, and BUFm may be the data voltages.

For example, an output terminal of an m-th buffer unit BUFm may be connected to an m-th data line DLm, and the m-th buffer unit BUFm may receive a buffer power voltage and a ground power voltage GND. At this time, the buffer power voltage may be the data driving voltage AVDD. The buffer power voltage may determine an upper limit of the output voltage (that is, the data voltage) of the buffer unit BUFm. In addition, the ground power voltage GND may determine a lower limit of the output voltage of the buffer unit BUFm. The buffer unit BUFm may be further applied with voltages other than the buffer power voltage and the ground power voltage GND according to a configuration thereof. The other voltages may be control voltages that determine a slew rate of the buffer unit BUFm. The control voltages are different from the buffer power voltage and the ground power voltage GND in that the control voltages are not voltages that determine the upper or lower limit of the output voltage of the buffer unit BUFm.

Figure 8:
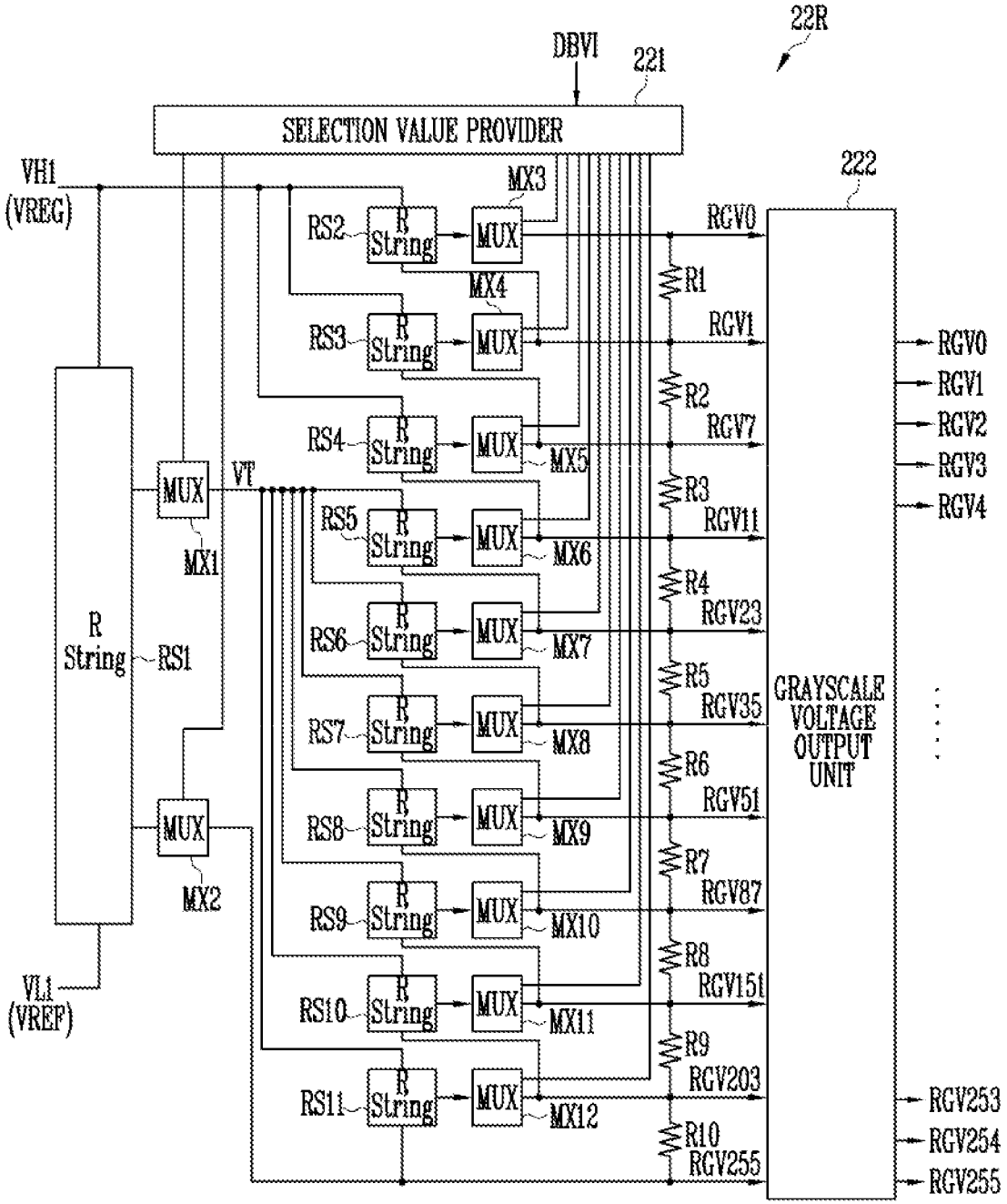
FIG. 8 is a block diagram for describing a grayscale voltage generator according to an embodiment of the disclosure.

FIG. 8 is a diagram for describing the grayscale voltage generator according to an embodiment of the disclosure.

Referring to FIG. 8, an exemplary first color grayscale voltage generator 22R is shown. Other color grayscale voltage generators may be configured to be substantially the same as the first color grayscale voltage generator 22R, and thus repetitive description will be omitted. However, selection values stored in a selection value provider of the other color grayscale voltage generators may be different from selection values stored in a selection value provider 221 of the first color grayscale voltage generator 22R.

The first color grayscale voltage generator 22R may include the selection value provider 221, a grayscale voltage output unit 222, resistor strings RS1 to RS11, multiplexers MX1 to MX12, and resistors R1 to R10.

The selection value provider 221 may provide selection values for the multiplexers MX1 to MX12 according to an input maximum luminance value DBVI. The selection values according to the input maximum luminance value DBVI may be stored in advance in a memory element, for example, an element such as a register.

Hereinafter, for convenience of description, a total of 256 grayscales from 0th grayscale (e.g., a minimum grayscale) to 255th grayscale (e.g., a maximum grayscale) are present, but more grayscales may be present when the grayscale value is expressed by 8 bits or more. The minimum grayscale is the darkest grayscale, and the maximum grayscale may be the brightest grayscale.

The maximum luminance value may be a luminance value of light emitted from the pixels in correspondence with the maximum grayscale. For example, the maximum luminance value may be a luminance value of white line generated by emitting a pixel of a first color forming one dot in correspondence with 255 grayscales, emitting a pixel of a second color in correspondence with 255 grayscales, and emitting a pixel of a third color in correspondence with 255 grayscales. A unit of a luminance value may be nit.

Therefore, the pixels PXij may partially or spatially display a dark or bright image frame, but a maximum brightness of the image frame is limited to the maximum luminance value. The maximum luminance value may be manually set by a user's manipulation of the display device 1 or may be set automatically by an algorithm associated with an illuminance sensor or the like. At this time, the set maximum luminance value is referred to as the input maximum luminance value DBVI. The first color grayscale voltage generator 22R may be configured to directly receive the input maximum luminance value DBVI from an external processor, or may be configured to receive the input maximum luminance value DBVI through the timing controller 10.

For example, a maximum value of the maximum luminance value may be 1200 nits, and a minimum value may be 4 nits even though the maximum value and the minimum value may vary according to a product. Even though the grayscale value is the same, when the input maximum luminance value DBVI is changed, the first color grayscale voltage generator 22R provides different grayscale voltages, and thus a light emission luminance of the pixel is also changed.

The resistor string RS1 may generate intermediate voltages of the gamma voltage VREG applied to a first high voltage terminal VH1 and the reference voltage VREF applied to a first low voltage terminal VL1. Here, the gamma voltage VREG may be greater than the reference voltage VREF. The multiplexer MX1 may select one of the intermediate voltages provided from the resistor string RS1 according to the selection value of the selection signal, and output a voltage VT. The multiplexer MX2 may select one of the intermediate voltages provided from the resistor string RS1 according to the selection value, and output a 255th grayscale voltage RGV255.

The resistor string RS11 may generate intermediate voltages of the voltage VT and the 255th grayscale voltage RGV255. The multiplexer MX12 may select one of the intermediate voltages provided from the resistor string RS11 according to the selection value of the selection signal, and output a 203rd grayscale voltage RGV203.

The resistor string RS10 may generate intermediate voltages of the voltage VT and the 203rd grayscale voltage RGV203. The multiplexer MX11 may select one of the intermediate voltages provided from the resistor string RS10 according to the selection value of the selection signal, and output a 151st grayscale voltage RGV151.

The resistor string RS9 may generate intermediate voltages of the voltage VT and the 151st grayscale voltage RGV151. The multiplexer MX10 may select one of the intermediate voltages provided from the resistor string RS9 according to the selection value of the selection signal, and output an 87th grayscale voltage RGV87.

The resistor string RS8 may generate intermediate voltages of the voltage VT and the 87th grayscale voltage RGV87. The multiplexer MX9 may select one of the intermediate voltages provided from the resistor string RS8 according to the selection value of the selection signal, and output a 51st grayscale voltage RGV51.

The resistor string RS7 may generate intermediate voltages of the voltage VT and the 51st grayscale voltage RGV51. The multiplexer MX8 may select one of the intermediate voltages provided from the resistor string RS7 according to the selection value of the selection signal, and output a 35th grayscale voltage RGV35.

The resistor string RS6 may generate intermediate voltages of the voltage VT and the 35th grayscale voltage RGV35. The multiplexer MX7 may select one of the intermediate voltages provided from the resistor string RS6 according to the selection value of the selection signal, and output a 23rd grayscale voltage RGV23.

The resistor string RS5 may generate intermediate voltages of the voltage VT and the 23rd grayscale voltage RGV23. The multiplexer MX6 may select one of the intermediate voltages provided from the resistor string RS5 according to the selection value of the selection signal, and output an 11th grayscale voltage RGV11.

The resistor string RS4 may generate intermediate voltages of the gamma voltage VREG and the 11th grayscale voltage RGV11. The multiplexer MX5 may select one of the intermediate voltages provided from the resistor string RS4 according to the selection value of the selection signal, and output a 7th grayscale voltage RGV7.

The resistor string RS3 may generate intermediate voltages of the gamma voltage VREG and the 7th grayscale voltage RGV7. The multiplexer MX4 may select one of the intermediate voltages provided from the resistor string RS3 according to the selection value of the selection signal, and output a 1 grayscale voltage RGV1.

The resistor string RS2 may generate intermediate voltages of the gamma voltage VREG and the 1 grayscale voltage RGV1. The multiplexer MX3 may select one of the intermediate voltages provided from the resistor string RS2 according to the selection value of the selection signal, and output a 0th grayscale voltage RGV0.

The above-described 0, 1, 7, 11, 23, 35, 51, 87, 151, 203, and 255 grayscales may be referred to as reference grayscales. In addition, the grayscale voltages RGV0, RGV1, RGV7, RGV11, RGV23, RGV35, RGV51, RGV87, RGV151, RGV203, and RGV255 generated from the multiplexers MX2 to MX12 may be referred to as reference grayscale voltages. The number of reference grayscales and a grayscale number corresponding to the reference grayscales may be set differently according to a product. Hereinafter, for convenience of description, the 0, 1, 7, 11, 23, 35, 51, 87, 151, 203, and 255 grayscales will be described as the reference grayscales.

The grayscale voltage output unit 222 may divide the reference grayscale voltages RGV0, RGV1, RGV7, RGV11, RGV23, RGV35, RGV51, RGV87, RGV151, RGV203, and RGV255 to generate first color grayscale voltages RGV0 to RGV255. For example, the grayscale voltage output unit 222 may divide the reference grayscale voltages RGV1 and RGV7 to generate first color grayscale voltages RGV2 to RGV6.

Figure 9:
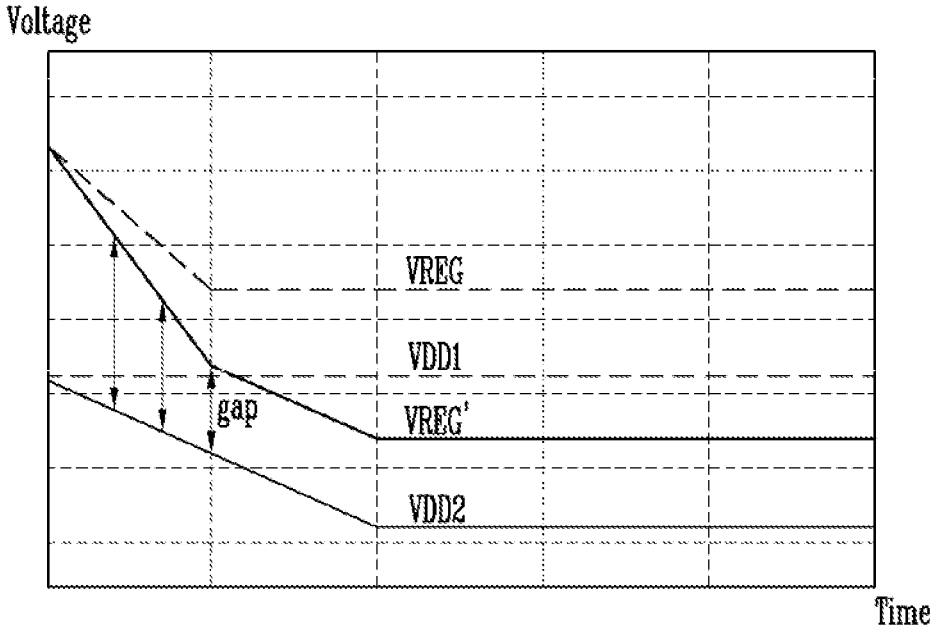
FIG. 9 is a timing diagram for describing a problem that occurs when a first power voltage is changed during a period in which a display mode is switched.

FIG. 9 is a diagram for describing a problem that occurs when the first power voltage is changed during a period in which the display mode is switched.

Referring to FIGS. 1 and 9, a graph shown in FIG. 9 is a diagram illustrating a period in which the display mode is switched and a portion of the period in which the display mode is switched. For example, the graph shown in FIG. 9 may illustrate a transition period in which the display mode is switched from the first display mode in which the image frames are displayed at 60 Hz to the second display mode that is a low power display mode (or in which the image frames are displayed at 1 Hz) and a portion of a period of the second display mode. Hereinafter, for convenience, the present embodiments will be described based on a case where the display mode is switched from the first display mode to the second display mode.

When the first power voltage VDD1 is constant regardless of the switch of the display mode, when the display mode is switched from the first display mode to the second display mode, in order to reduce power consumption, the second power voltage VSS, the data driving voltage AVDD, and the like may be reduced according to a characteristic of the switched display mode, and thus the gamma voltage VREG may also be reduced.

At this time, a main reason that the gamma voltage VREG is reduced during the period in which the display mode is switched from the first display mode to the second display mode is because the second power voltage VSS and the data driving voltage AVDD, and the like are reduced.

During the period of the second display mode, a gap between the gamma voltage VREG and the first power voltage VDD1 is maintained so that the driving current flows to generate the luminance used in the pixel PXij. To this end, the gamma voltage VREG may be increased or decreased according to a ripple of a first power voltage VDD1 so that the gap is maintained.

In a case where a first power voltage VDD2 is also reduced when the display mode is switched from the first display mode to the second display mode, power consumption may be further reduced since the gamma voltage VREG' is reduced to a smaller value according to the reduced first power voltage VDD2, and a gap between the gamma voltage VREG' and the first power voltage VDD2 is gradually reduced during the period in which the display mode is switched from the first display mode to the second display mode.

When the gap between the gamma voltage VREG' and the first power voltage VDD2 is gradually reduced, the driving current flowing through the pixel PXij is also not constant. In addition, the pixel PXij does not emit light at a used luminance, and a luminance deviation occurs in a switch period of the display mode.

This is because the driving current greatly changes when the gamma voltage greatly changes since the driving current is influenced by a difference between the first power voltage VDD and the data voltage and the data voltage is determined by the gamma voltage.

Since the luminance deviation occurring when the display mode is switched is perceived to the user, a problem that the user feels sense or difference occurs.

Although not shown, differently from that shown in FIG. 9, when the display mode is switched from the second display mode to the first display mode, the reduced first power voltage VDD2 is increased again and the gamma voltage VREG' is increased to a larger value according to the increased first power voltage VDD2. Therefore, there is a problem that the gap between the gamma voltage VREG' and the first power voltage VDD2 need not be maintained to be constant (in this case, a size of the gap is gradually increased) during a period in which the display mode is switched from the second display mode to the first display mode.

Therefore, the gap between the gamma voltage and the first power voltage is used to be maintained to be constant in order to prevent a luminance difference that may occur in the period in which the display mode is switched while reducing the first power voltage to reduce power consumption.

Figure 10:
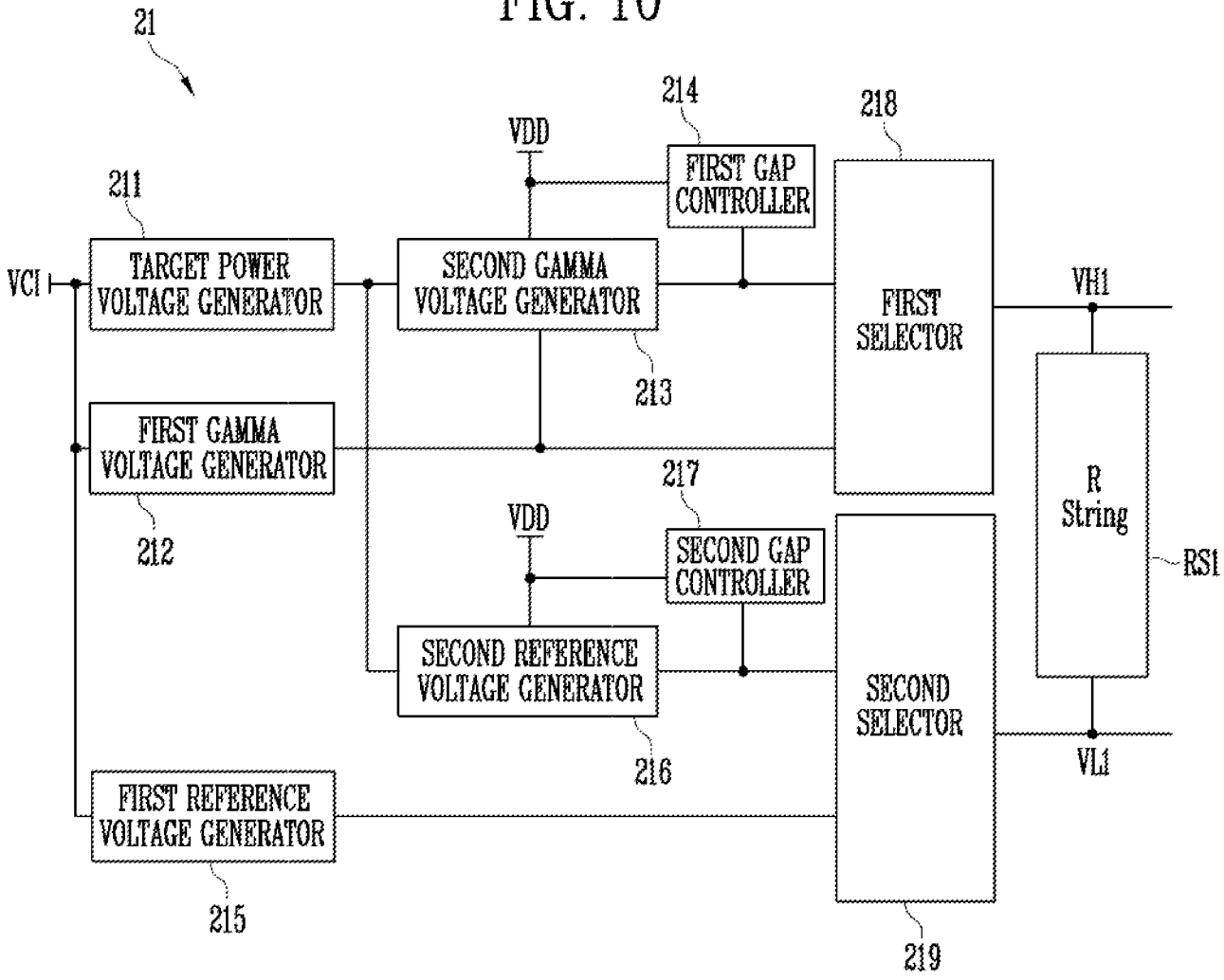
FIG. 10 is a block diagram for describing a power converter according to an embodiment of the disclosure.

FIG. 10 is a diagram for describing the power converter according to an embodiment of the disclosure.

Referring to FIG. 10, the power converter 21 according to an embodiment of the disclosure may receive the first power voltage VDD and the second external input voltage VCI supplied to the pixels, provide the gamma voltage used for the control of the pixels to a first output terminal, and provide the reference voltage to a second output terminal. Here, the first output terminal and the second output terminal may refer to the first high voltage terminal VH1 and the first low voltage terminal VL1 described above with reference to FIG. 8.

The power converter 21 may include a target power voltage generator 211, a first gamma voltage generator 212, a second gamma voltage generator 213, a first gap controller 214, a first reference voltage generator 215, a second reference voltage generator 216, a second selector 219, and the like.

The target power voltage generator 211 may generate a target power voltage corresponding to the first power voltage VDD based on the second external input voltage VCI. Here, the target power voltage may refer to a voltage used for the pixel PXij to emit light.

The first gamma voltage generator 212 may generate a first gamma voltage based on the second external input voltage VCI. Here, the first gamma voltage may refer to a high-level voltage used to generate the grayscale voltages GV when the display device 1 operates in the second display mode.

The second gamma voltage generator 213 may generate a second gamma voltage based on the target power voltage, the first gamma voltage, and the first power voltage VDD. Here, the second gamma voltage may refer to a high voltage used to generate the grayscale voltages GV when the display device 1 operates in the first display mode.

The first gap controller 214 may generate the second gamma voltage based on the first power voltage VDD, a preset reference target power voltage, and the reference gamma voltage during a period in which the display mode in which the pixels display the frames at the driving frequency is switched. Here, the reference target power voltage and the reference gamma voltage may be for maintaining a gap between the gamma voltage and the first power voltage VDD during the period in which the display mode is switched, may be determined in advance by an experiment, and may be stored in a memory existing inside or outside the first gap controller 214.

Here, an output terminal of the second gamma voltage generator 213 and an output terminal of the first gap controller 214 may be electrically connected to the same node and configured as one output terminal. The one output terminal may be electrically connected to the first selector 218.

At this time, the first gap controller 214 may be turned on and operated only during the period in which the display mode is switched so that the second gamma voltage output from the second gamma voltage generator 213 and the second gamma voltage output from the first gap controller 214 are not simultaneously input to the first selector 218.

The first selector 218 may be electrically connected to an output terminal at which the output terminal of the second gamma voltage generator 213 and the output terminal of the first gap controller 214 are electrically connected to each other at the same node, and may be electrically connected to an output terminal of the voltage generator 212.

The first selector 218 may selectively output one of the first gamma voltage and the second gamma voltage to the first output terminal (or the first high voltage terminal VH1) of the power converter 21 according to the display mode. For example, when the display device 1 operates in the first display mode, the first selector 218 may output the second gamma voltage to the first output terminal (or the first high voltage terminal VH1) of the power converter 21. For another example, when the display device 1 operates in the second display mode, the first selector 218 may output the first gamma voltage to the first output terminal (or the first high voltage terminal VH1) of the power converter 21.

The first reference voltage generator 215 may generate a first reference voltage based on the second external input voltage VCI. Here, the first reference voltage may refer to a low-level voltage used to generate the grayscale voltages GV when the display device 1 operates in the second display mode.

The second reference voltage generator 216 may generate a second reference voltage based on the target power voltage, the first reference voltage, and the first power voltage VDD. Here, the second reference voltage may refer to a low voltage used to generate the grayscale voltages GV when the display device 1 operates in the first display mode.

The second gap controller 217 may generate the second reference voltage based on the first power voltage VDD, a preset reference target power voltage, and a reference voltage during the period in which the display mode is switched. Here, the preset reference target power voltage and the reference voltage may be determined in advance by an experiment similarly to the reference target power voltage and the reference gamma voltage described above, and may be stored in a memory existing inside or outside the second gap controller 217.

Here, an output terminal of the second reference voltage generator 216 and an output terminal of the second gap controller 217 may be electrically connected to the same node and configured as one output terminal. The one output terminal may be electrically connected to the second selector 219.

At this time, the second gap controller 217 may be turned on and operated only during the period in which the display mode is switched identically to the first gap controller 214 so that the second reference voltage output from the second reference voltage generator 216 and the second reference voltage output from the second gap controller 217 are not simultaneously input to the second selector 219.

The second selector 219 may be electrically connected to the output terminal at which the output terminal of the second reference voltage generator 216 and the output terminal of the first gap controller 214 are electrically connected to each other at the same node, and may be electrically connected to the output terminal of the first reference voltage generator 215.

The second selector 219 may selectively output one of the first reference voltage and the second reference voltage to the second output terminal (or the first low voltage terminal VL1) of the power converter 21 according to the display mode.

Figure 11:
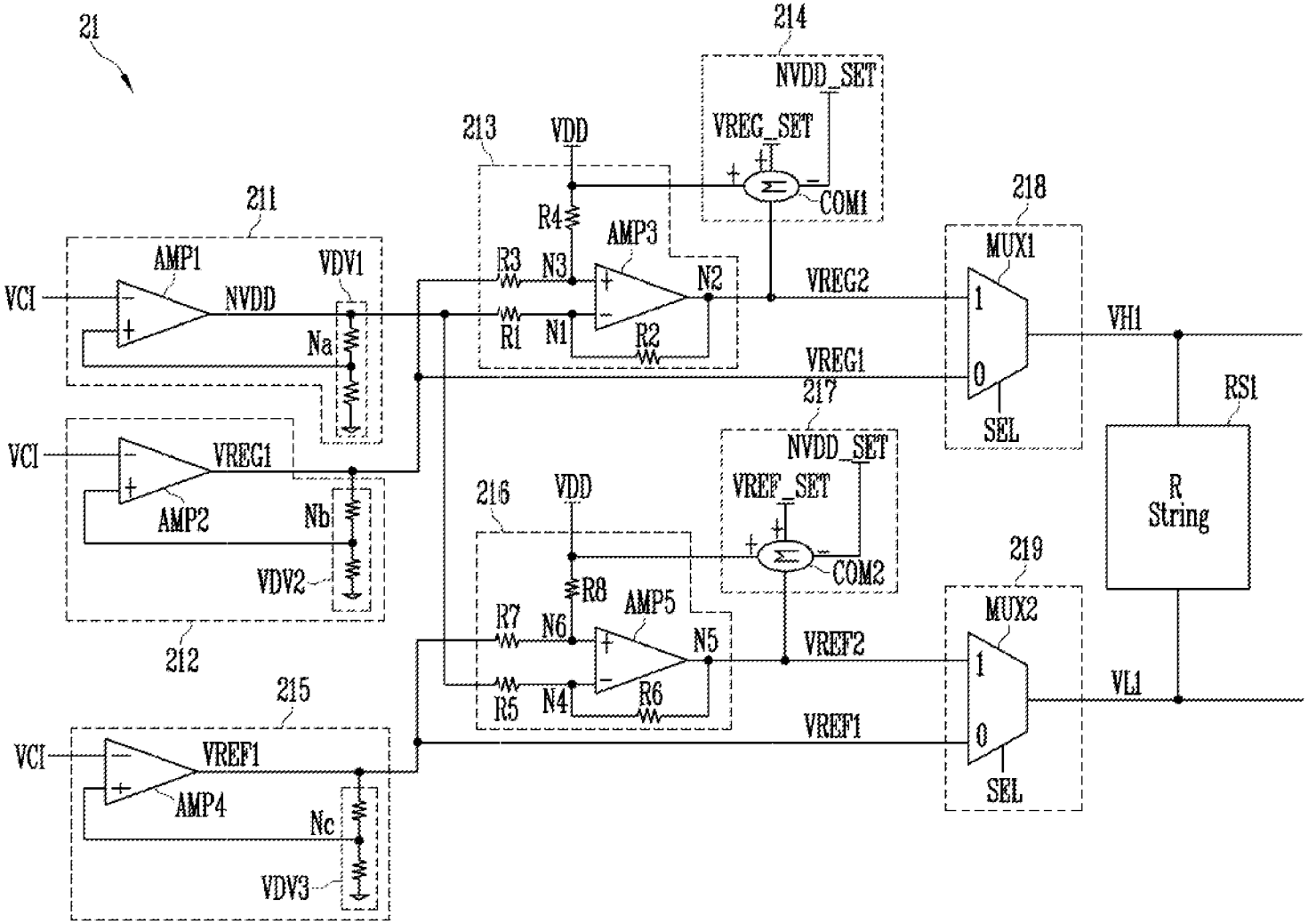
FIG. 11 is an equivalent circuit diagram of the power converter according to an embodiment of the disclosure.

FIG. 11 is an equivalent circuit diagram of the power converter according to an embodiment of the disclosure.

Referring to FIG. 11, the target power voltage generator 211 may include a first amplifier AMP1 and a first voltage divider VDV1.

The first amplifier AMP1 may include a first input terminal to which the second external input voltage VCI is input, a second input terminal to which a feedback voltage of a target power voltage NVDD is input, and an output terminal from which the target power voltage NVDD is output. Here, the first input terminal of the first amplifier AMP1 may be an inverted terminal, and the second input terminal of the first amplifier AMP1 may be a non-inverted terminal.

The first voltage divider VDV1 may output the feedback voltage of the target power voltage NVDD to the second input terminal of the first amplifier AMP1. The first voltage divider VDV1 may be configured of a plurality of resistors, and a conductive line extending from a node Na to which the plurality of resistors are connected may be electrically connected to the second input terminal of the first amplifier AMP1. At this time, a voltage of the node Na may be the feedback voltage of the target power voltage NVDD, and the voltage of the node Na may be input to the second input terminal of the first amplifier AMP1.

The first gamma voltage generator 212 may include a second amplifier AMP2 and a second voltage divider VDV2.

The second amplifier AMP2 may include a first input terminal to which the second external input voltage VCI is input, a second input terminal to which a feedback voltage of the first gamma voltage VREG1 is input, and an output terminal from which the first gamma voltage VREG1 is output.

The second voltage divider VDV2 may output the feedback voltage of the first gamma voltage VREG1 to the second input terminal of the second amplifier AMP2. The second voltage divider VDV2 may be configured of a plurality of resistors, similarly to the first voltage divider VDV1, and a conductive line extending from a node Nb to which the plurality of resistors are connected may be electrically connected to the second input of the second amplifier AMP2.

At this time, a voltage of the node Nb may be the feedback voltage of the first gamma voltage VREG1.

The second gamma voltage generator 213 may include a first resistor R1, a second resistor R2, a third resistor R3, a fourth resistor R4, and a third amplifier AMP3.

The first resistor R1 may include a first terminal connected to the output terminal of the target power voltage generator 211, and a second terminal. Specifically, the first terminal of the first resistor R1 may be connected to the output terminal of the first amplifier AMP1, and the second terminal of the first resistor R1 may be connected to the first node N1.

The second resistor R2 may include a first terminal connected to the first node N1, and a second terminal connected to the second node N2.

The third resistor R3 may include a first terminal connected to the output terminal of the first gamma voltage generator 212, and a second terminal. Specifically, the first terminal of the third resistor R3 may be connected to the output terminal of the second amplifier AMP2, and the second terminal of the third resistor R3 may be connected to a third node N3.

The fourth resistor R4 may include a first terminal connected to the first power voltage, and a second terminal connected to the third node N3.

Here, respective resistance values of the first resistor R1, the second resistor R2, the third resistor R3, and the fourth resistor R4 may be different values, and may be the same values. Hereinafter, for convenience, the present embodiments will be described under an assumption that all of the respective resistance values of the first resistor R1, the second resistor R2, the third resistor R3, and the fourth resistor R4 are the same values.

The third amplifier AMP3 may include a first input terminal connected to the first node N1, a second input terminal connected to the third node N3, and an output terminal from which the second gamma voltage VREG2 is output. Here, the first input terminal of the second amplifier AMP2 may be an inverted terminal, and the second input terminal of the second amplifier AMP2 may be a non-inverted terminal.

The first gap controller 214 may include a first operation circuit COM1 that performs an operation using the pre-stored reference target power voltage NVDD_SET, the reference gamma voltage VREG_SET, and the first power voltage VDD.

The first selector 218 may receive a selection signal SEL instructing the display mode, and output any one of the first gamma voltage VREG1 and the second gamma voltage VREG2 to the first output terminal (or the first high voltage terminal VH1) according to the display mode instructed by the selection signal SEL.

Specifically, the first selector 218 may receive a first selection signal instructing the first display mode displaying the frames at the first driving frequency or a second selection signal instructing the second display mode displaying the frames at the second driving frequency less than the first driving frequency. Here, the first selection signal and the second selection signal may be signals of a pulse type. A pulse of the first selection signal may have a first polarity, a high level, and a digital value of 1. A pulse of the second selection signal may have a second polarity, a low level, and a digital value of 0. However, the disclosure is not limited thereto, and the pulses of each of the first selection signal and the second selection signal may be set differently from the above-described example according to an experiment or a product.

As an embodiment, when the first selector 218 receives the first selection signal, the second gamma voltage VREG2 may be output to the first output terminal (or the first high voltage terminal VH1).

As another embodiment, when the first selector 218 receives the second selection signal, the first gamma voltage VREG1 may be output to the first output terminal (or the first high voltage terminal VH1).

The first selector 218 may include a first multiplexer MUX1. The first multiplexer MUX1 may include a first input terminal connected to the output terminal of the second gamma voltage generator 213 and the output terminal of the first gap controller 214, a second input terminal connected to the output terminal of the first gamma voltage generator 212, a third input terminal to which the first selection signal or the second selection signal is applied, and an output terminal from which the first gamma voltage VREG1 or the second gamma voltage VREG2 is output.

For a specific example, the first input terminal of the first multiplexer MUX1 is connected to the second node N2, the second input terminal of the first multiplexer MUX1 is connected to the output terminal of the second amplifier AMP2, the third input terminal of the first multiplexer MUX1 receives the selection signals, and the first gamma voltage VREG1 or the second gamma voltage VREG2 is output at the output terminal of the first multiplexer MUX1. At this time, the output terminal of the first multiplexer MUX1 may refer to the first output terminal (or the first high voltage terminal VH1) of the power converter 21.

As described above, the first selector 218 may be implemented as the first multiplexer MUX1, but is not limited thereto, and the first selector 218 may include a plurality of switches instead of the first multiplexer MUX1.

The first reference voltage generator 215 may include a fourth amplifier AMP4 and a third voltage divider VDV3.

The fourth amplifier AMP4 may include a first input terminal to which the second external input voltage VCI is input, a second input terminal to which a feedback voltage of the first reference voltage VREF1 is input, and an output terminal from which the first reference voltage VREF1 is output. Here, the first input terminal of the fourth amplifier AMP4 may be an inverted terminal, and the second input terminal of the fourth amplifier AMP4 may be a non-inverted terminal.

The third voltage divider VDV3 may output the feedback voltage of the first reference voltage VREF1 to the second input terminal of the fourth amplifier AMP4. The third voltage divider VDV3 may be configured of a plurality of resistors, similarly to the first voltage divider VDV1 and the second voltage divider VDV2, and a conductive line extending from a node Nc to which the plurality of resistors are connected may be electrically connected to the second input terminal of the fourth amplifier AMP4. At this time, a voltage of the node Nc may be the feedback voltage of the first reference voltage VREF1.

The second reference voltage generator 216 may include a fifth resistor R5, a sixth resistor R6, a seventh resistor R7, an eighth resistor R8, and the fourth amplifier AMP4.

The fifth resistor R5 may include a first terminal connected to the output terminal of the target power voltage generator 211, and a second terminal. Specifically, the first terminal of the fifth resistor R5 may be connected to the output terminal of the first amplifier AMP1, and the second terminal of the fifth resistor R5 may be connected to a fourth node N4.

The sixth resistor R6 may include a first terminal connected to the fourth node N4, and a second terminal connected to a fifth node N5.

The seventh resistor R7 may include a first terminal connected to the output terminal of the first reference voltage generator 215, and a second terminal. Specifically, the first terminal of the seventh resistor R7 may be connected to the output terminal of the fourth amplifier AMP4, and the second terminal of the seventh resistor R7 may be connected to a sixth node N6.

The eighth resistor R8 may include a first terminal connected to the first power voltage, and a second terminal connected to the sixth node N6.

Here, respective resistance values of the fifth resistor R5, the sixth resistor R6, the seventh resistor R7, and the eighth resistor R8 may be different values, and may be the same value. Hereinafter, for convenience, the present embodiments will be described under an assumption that all of the respective resistance values of the fifth resistor R5, the sixth resistor R6, the seventh resistor R7, and the eighth resistor R8 are the same values.

The fifth amplifier AMP5 may include a first input terminal connected to the fourth node N4, a second input terminal connected to the sixth node N6, and an output terminal from which the second reference voltage VREF2 is output. Here, the first input terminal of the fifth amplifier AMP5 may be an inverted terminal, and the second input terminal of the fifth amplifier AMP5 may be a non-inverted terminal.

The second gap controller 217 may include a second operation circuit COM2 that performs an operation using the pre-stored reference target power voltage NVDD_SET, the reference voltage VREF_SET, and the first power voltage VDD.

Identically to the first selector 218, the second selector 219 may receive the selection signal SEL instructing the display mode and output any one of the first reference voltage VREF1 and the second reference voltage VREF2 to the second output terminal (or the first low voltage terminal VL1) according to the display mode instructed by the selection signal SEL.

For example, when the second selector 219 receives a first selection signal, the second reference voltage VREF2 may be output to the second output terminal (or the first low voltage terminal VL1). For another example, when the second selector 219 receives a second selection signal, the first reference voltage VREF1 may be output to the second output terminal (or the first low voltage terminal VL1).

The second selector 219 may include a second multiplexer MUX2. The second multiplexer MUX2 may include a first input terminal, a second input terminal, a third input terminal, and an output terminal.

For a specific example, the first input terminal of the second multiplexer MUX2 is connected to the second node N2, the second input terminal of the second multiplexer MUX2 is connected to the output terminal of the second amplifier AMP2, the third input terminal of the second multiplexer MUX2 receives the selection signals, and the output terminal of the second multiplexer MUX2 outputs the first gamma voltage VREG1 or the second gamma voltage VREG2. At this time, the output terminal of the second multiplexer MUX2 may refer to the second output terminal (or the first low voltage terminal VL) of the power converter 21.

As described above, the second selector 219 may include a plurality of switches instead of the second multiplexer MUX2.

Figure 12:
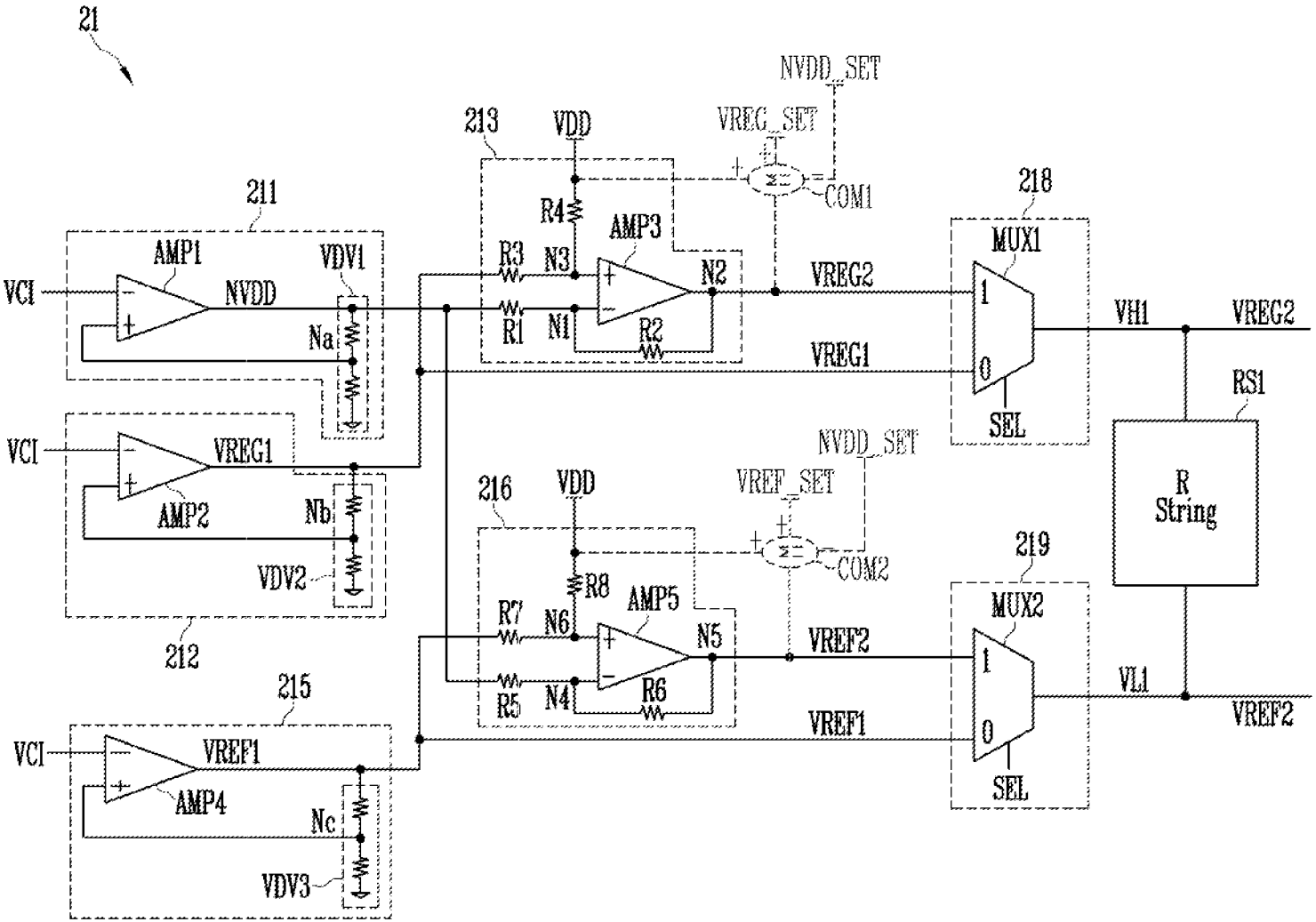
FIG. 12 is a circuit diagram illustrating an embodiment in which the power converter shown in FIG. 11 operates during a period of a first display mode.

FIG. 12 is a diagram illustrating an embodiment in which the power converter shown in FIG. 11 operates during a period of the first display mode.

Referring to FIG. 12, during the first display mode in which the pixels display the frames at the first driving frequency, the third amplifier AMP3 may be turned on. For example, when power used for driving the third amplifier AMP3 is supplied, the third amplifier AMP3 may be turned on.

At this time, when all resistance values of the first resistor R1, the second resistor R2, the third resistor R3, and the fourth resistor R4 are the same, the third amplifier AMP3 may output the second gamma voltage VREG2 based on a difference value between the first power voltage VDD and the target power voltage NVDD, and the first gamma voltage VREG1. For example, the second gamma voltage VREG2 may be calculated by Equation 1 below.

$$VREG2=VREG1+(VDD-NVDD) \quad \text{[Equation 1]}$$

In the first display mode in which the pixels display the frames at the first driving frequency, the fifth amplifier AMP5 may be turned on similarly to the third amplifier AMP3.

Also at this time, when all resistance values of the fifth resistor R5, the sixth resistor R6, the seventh resistor R7, and the eighth resistor R8 are the same, the fifth amplifier AMP5 may output the second reference voltage VREF2 based on a difference value between the first power voltage VDD and the target power voltage NVDD, and the first reference voltage VREF1. For example, the second reference voltage VREF2 may be calculated by Equation 2 below.

$$VREF2=VREF1+(VDD-NVDD) \quad \text{[Equation 2]}$$

The first gap controller 214 may be turned off and need not operate during the period of the first display mode. In addition, the second gap controller 217 may also be turned off and need not operate during the period of the first display mode.

Here, in a case of the first display mode, since the first selection signal is input to each of the first selector 218 and the second selector 219, the first selector 218 may output the second gamma voltage VREG2 output from the third amplifier AMP3 to the first output terminal (or the first high voltage terminal VH1), and the second selector 219 may output the second reference voltage VREF2 output from the fifth amplifier AMP5 to the second output terminal (or the first low voltage terminal VL1).

Figure 13:
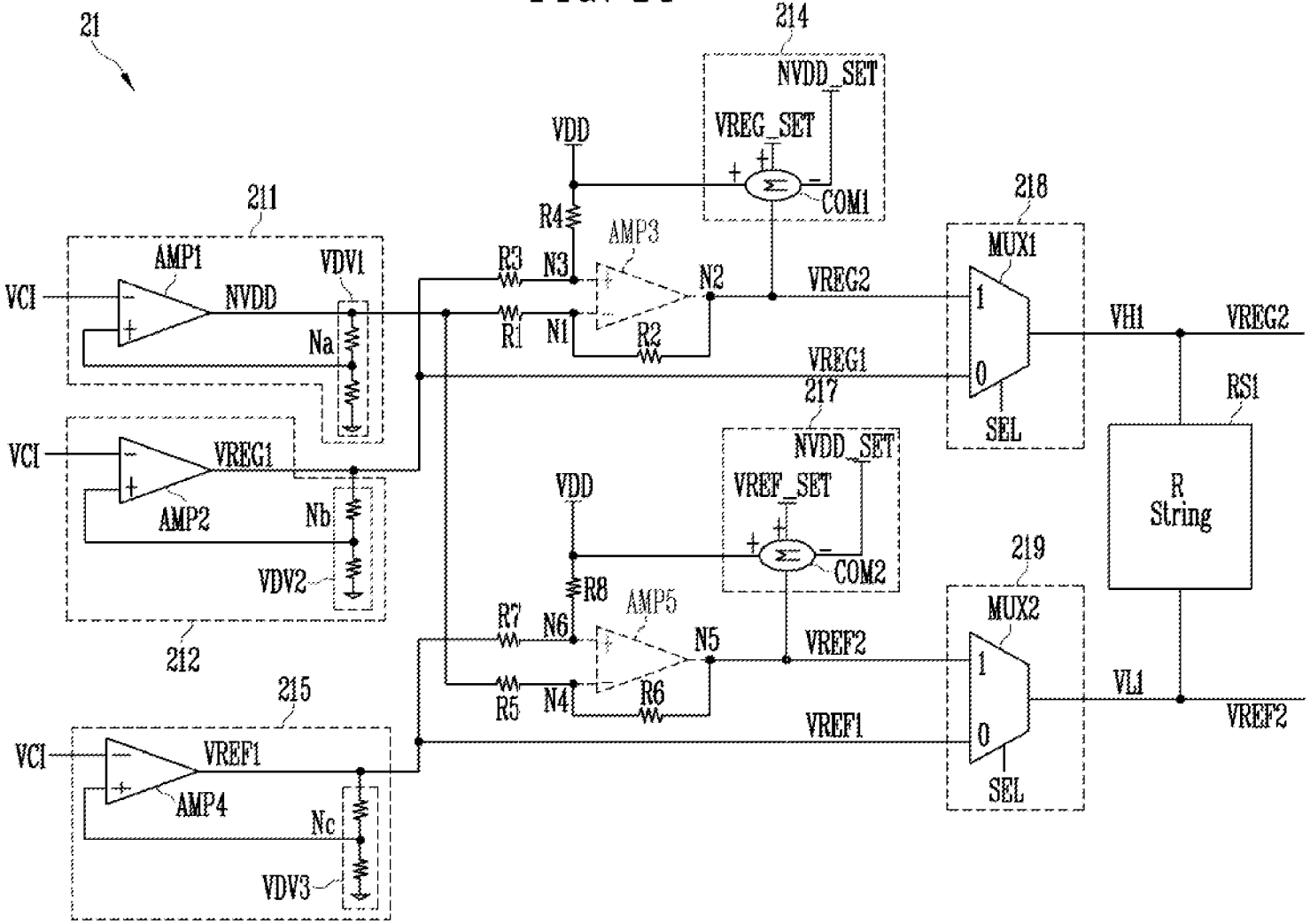
FIG. 13 is a circuit diagram illustrating an embodiment in which the power converter shown in FIG. 11 operates during a switch period of the display mode.

FIG. 13 is a diagram illustrating an embodiment in which the power converter shown in FIG. 11 operates during the switch period of the display mode.

Referring to FIG. 13, the switch period of the display mode may be a period in which the display mode is switched between the first display mode and the second display mode, and may refer to a period in which the display mode is switched from the first display mode to the second display mode or a period in which the display mode is switched from the second display mode to the first display mode.

As an embodiment, during a period in which the display mode is switched between the second display mode in which the pixels display the frames at the second drive frequency less than the first drive frequency, and first display mode, the third amplifier AMP3 may be turned off, and the first gap controller 214 may be turned on.

This prevents the second gamma voltage VREG2 output from the first gap controller 214 and the second gamma voltage VREG2 output from the third amplifier AMP3 from being simultaneously input to the first selector 218, thereby preventing an incorrect operation.

The turned-on first gap controller 214 may generate the second gamma voltage VREG2 based on a difference value between the reference target power voltage and the reference gamma voltage, and the first power voltage VDD. For example, the second gamma voltage VREG2 may be calculated by Equation 3 below.

$$VREG2=VDD+(VREG_SET-NVDD_SET) \quad \text{[Equation 3]}$$

Here, NVDD_SET may refer to the reference target power voltage and VREG_SET may refer to the reference gamma voltage. Both values of each of the reference target power voltage and the reference gamma voltage may be predetermined constants and may be digital values. The second gamma voltage VREG2 may be changed according to the first power voltage VDD. Finally, a gap between the first power voltage VDD and the second gamma voltage VREG2 may be maintained during the switch period of the display mode.

Similarly to operation of the third amplifier AMP3, during the period in which the display mode is switched between the second display mode in which the frames are displayed at the second driving frequency less than the first driving frequency, and the first display mode, the fifth amplifier AMP5 may be turned off, and the second gap controller 217 may be turned on.

This prevents the second reference voltage VREF2 output from the second gap controller 217 and the second reference voltage VREF2 output from the fifth amplifier AMP5 from being simultaneously input to the second selector 219, thereby preventing an incorrect operation.

The turned-on second gap controller 217 may generate the second reference voltage VREF2 based on a difference value between the reference target power voltage and the reference voltage, and the first power voltage VDD. For example, the second reference voltage VREF2 may be calculated by Equation 4 below.

$$VREF2=VDD+(VREF_SET-NVDD_SET) \quad \text{[Equation 4]}$$

Here, NVDD_SET may refer to the reference target power voltage and VREG_SET may refer to a preset reference voltage. Both values of the reference target power voltage and the preset reference voltage may be predetermined constants and may be digital values. The second reference voltage VREF2 is changed according to the first power voltage VDD.

Here, in a case the period in which the display mode is switched, since the display mode has not yet been completely switched, the selection signal corresponding to the display mode before switching may be applied to each of the first selector 218 and the second selector 219 and may be maintained. As shown in FIG. 13, in a case of a period in which the display mode is switched from the first display mode to the second display mode, the first selection signal may be continuously input to each of the first selector 218 and the second selector 219.

However, since the first gap controller 214 and the second gap controller 217 are turned on and operated, and the third amplifier AMP3 and the fifth amplifier AMP5 are turned off and does not operate, during the period in which the display mode is switched, the first selector 218 may output the second gamma voltage VREG2 output from the first gap controller 214 to the first output terminal, and the second selector 219 may output the second reference voltage VREF2 output from the second gap controller 217 to the second output terminal (or the first low voltage terminal VL1).

Figure 14:
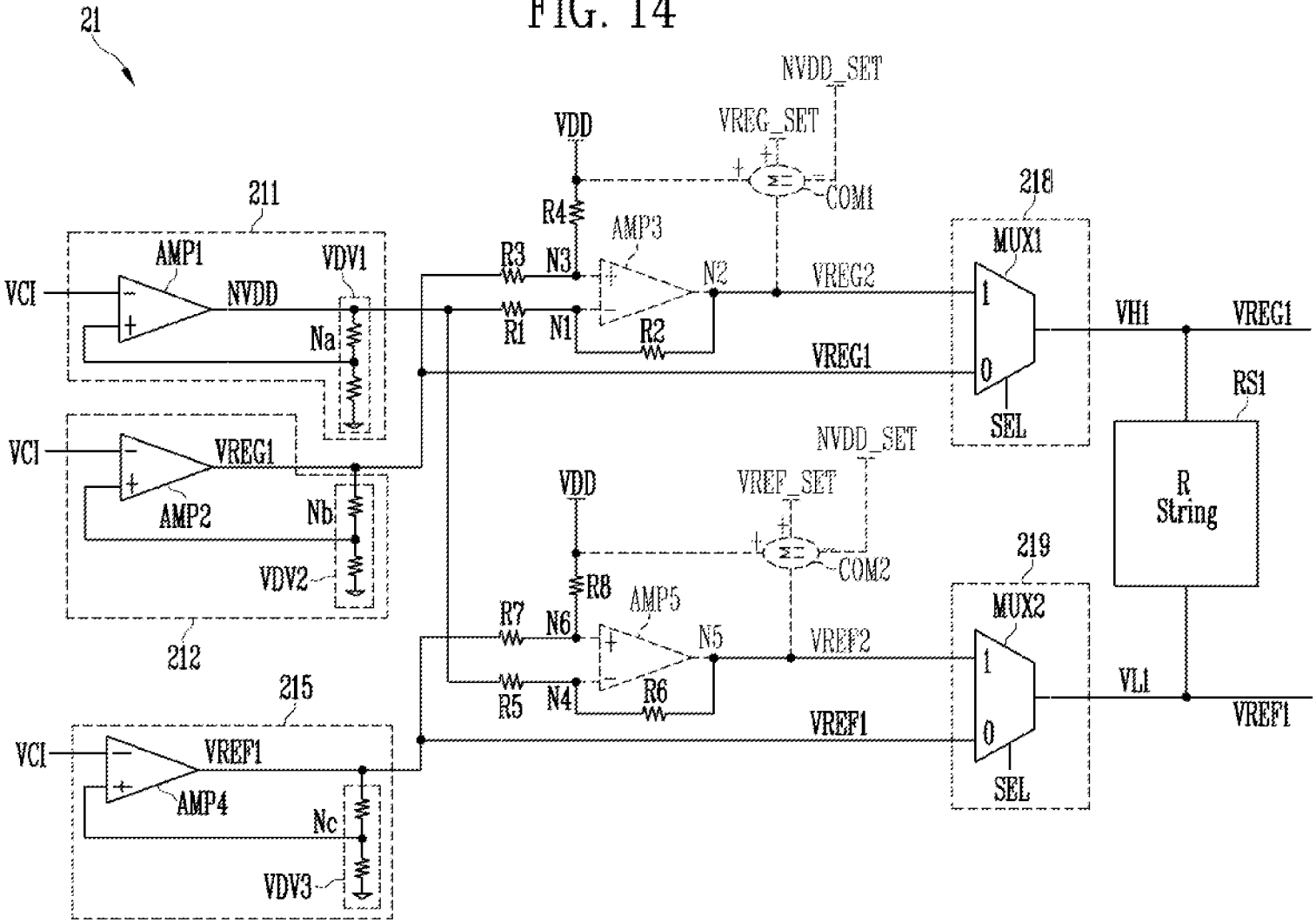
FIG. 14 is a circuit diagram illustrating an embodiment in which the power converter shown in FIG. 11 operates during a period of a second display mode.

FIG. 14 is a diagram illustrating an embodiment in which the power converter shown in FIG. 11 operates during a period of the second display mode.

Referring to FIG. 14, the third amplifier AMP3 and/or the fifth amplifier AMP5 may be turned off during the period of the second display mode. In addition, the first gap controller 214 and/or the second gap controller 217 may be turned off during the period of the second display mode. At this time, the second gamma voltage VREG2 and/or the second reference voltage VREF2 need not be generated.

In this case, the first selector 218 may receive the second selection signal and output the first gamma voltage VREG1 output by the first gamma voltage generator 212 to the first output terminal (or the first high voltage terminal VH1, and the second selector 219 may receive the second selection signal and output the first reference voltage VREF1 output by the first reference voltage generator 215 to the second output terminal (or the first low voltage terminal VL1.

As described above, when the third amplifier AMP3 and/or the fifth amplifier AMP5 are turned off during the period of the second display mode, since the first gamma voltage VREG1 and the first reference voltage VREF1 are determined based on the second external input voltage VCI regardless of the first power voltage VDD, power consumption is reduced.

The display device 1 may also apply the second gamma voltage VREG2 and the second reference voltage VREF2 to which the first power voltage VDD is reflected to the second display mode, in order to display a higher luminance image (or frame) in the second display mode. In this case, the third amplifier AMP3 and/or the fifth amplifier AMP5 may be turned on during the period of the second display mode.

Turn-on and turn-off time points of the third amplifier AMP3 and/or the fifth amplifier AMP5 are used to be adjusted for an effect of reducing power consumption and displaying an image of excellent image quality in the second display mode.

Figure 15:
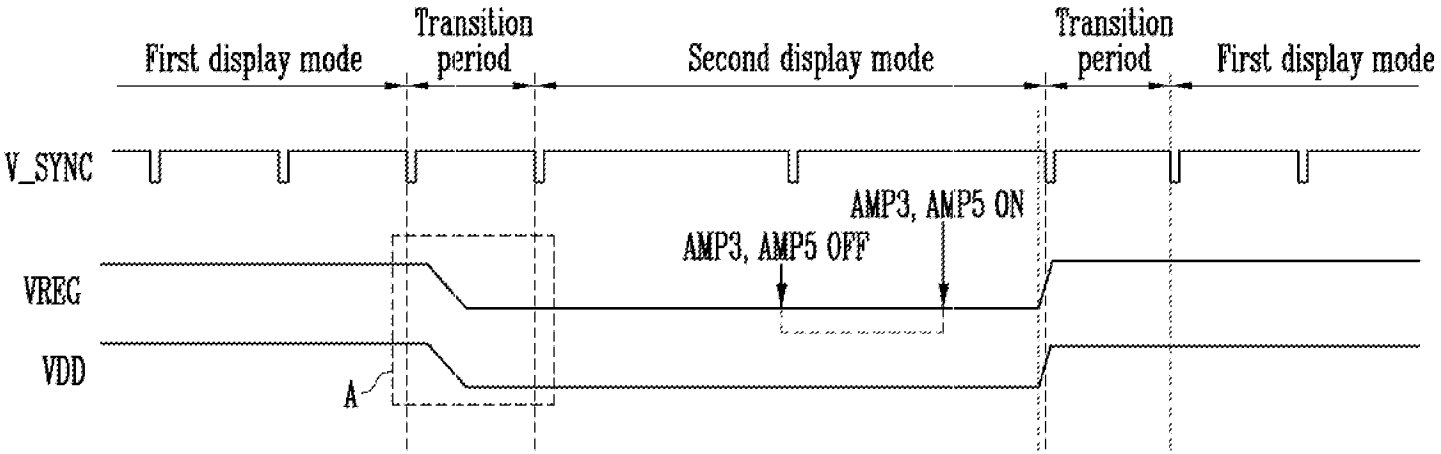
FIG. 15 is a timing diagram for describing turn-on and turn-off time points of a third amplifier and a fifth amplifier shown in FIGS. 11 to 14.

FIG. 15 is a diagram for describing the turn-on and turn-off time points of the third amplifier and the fifth amplifier shown in FIGS. 11 to 14.

Referring to FIG. 15, in a case of the first display mode, the display device 1 displays images frames at, for example, 60 Hz, and in a case of the second display mode, the display device 1 displays the image frames at, for example, 1 Hz. Therefore, a period in which a pulse of a vertical synchronization period v_sync in the first display mode occurs may be shorter than a period in which the pulse of the vertical synchronization period v_sync in the second display mode occurs.

The period in which the pulse of the vertical synchronization period v_sync occurs may correspond to one frame.

When the display mode is switched from the first display mode to the second display mode, the third amplifier AMP3 turned on in the first display mode may be turned off after at least one frame displayed after the transition period in which the display mode is switched from the first display mode to the second display mode.

Referring to FIG. 15, for example, the third amplifier AMP3 may be turned off after a first frame, which is to be initially displayed in the second display mode, is displayed.

Although not shown, for another example, the third amplifier AMP3 may be turned off during the transition period in which the display mode is switched from the first display mode to the second display mode.

Although not shown, for still another example, the third amplifier AMP3 may be turned off immediately after the transition period in which the display mode is switched from the first display mode to the second display mode elapses.

When an instruction signal for switching the display mode from the first display mode to the second display mode is received, the turned-off third amplifier AMP3 may be turned on during the period of the second display mode.

Similarly to the third amplifier AMP3, when the display mode is switched from the first display mode to the second display mode, the fifth amplifier AMP5 turned on in the first display mode may be turned off after at least one frame displayed after the transition period in which the display mode is switched from the first display mode to the second display mode. Referring to FIG. 15, for example, the fifth amplifier AMP5 may be turned off after the first frame to be initially displayed in the second display mode is displayed.

When the display mode is switched from the second display mode to the first display mode, the third amplifier AMP3 and/or the fifth amplifier AMP5 may be turned on before the transition period in which the display mode is switched from the second display mode to the first display mode.

Figure 16:
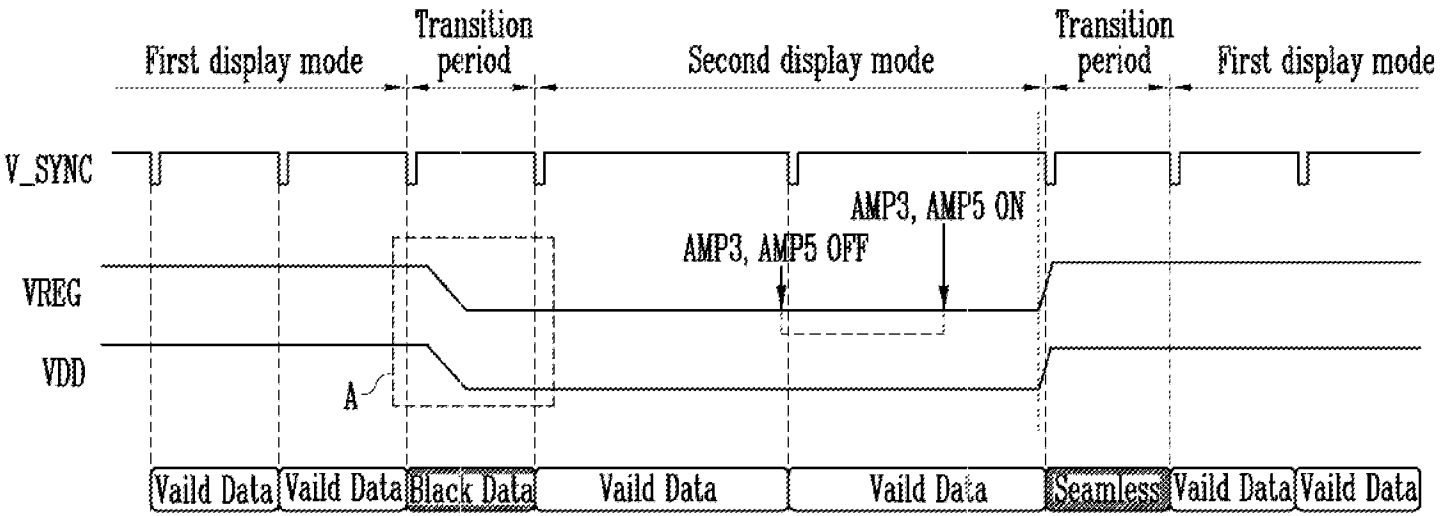
FIG. 16 is a timing diagram for describing an embodiment in which black data is applied during the period in which the display mode is switched from the first display mode to the second display mode of FIG. 15.

FIG. 16 is a diagram for describing an embodiment in which black data is applied during the period in which the display mode is switched from the first display mode to the second display mode of FIG. 15.

Referring to FIG. 16, during the transition period in which the display mode is switched from the first display mode to the second display mode, the black data (or a black frame) may be applied to the data lines DL1, DL2, DLj, and DLm. The black data may refer to data that causes the pixels PXij included in the display unit 50 to not emit light, and a grayscale corresponding to the black data may be a minimum grayscale, that is, the darkest grayscale.

As the black data is applied to the transition period in which the display mode is switched from the first display mode to the second display mode, a luminance change that may occur when the display mode is switched may be prevented from being recognized to the user.

When the black data is applied, in a case where the grayscale corresponding to the black data is slightly higher than the lowest grayscale, the transition period in which the display mode is switched from the first display mode to the second display mode, a flash may occur in the display unit 50.

In this case, the gap between the first power voltage VDD and the second gamma voltage VREG2 is maintained, thereby preventing occurrence of the flash in the display unit 50.

The black data need not be inserted during the transition period in which the display mode is switched from the second display mode to the first display mode.

Figure 17:
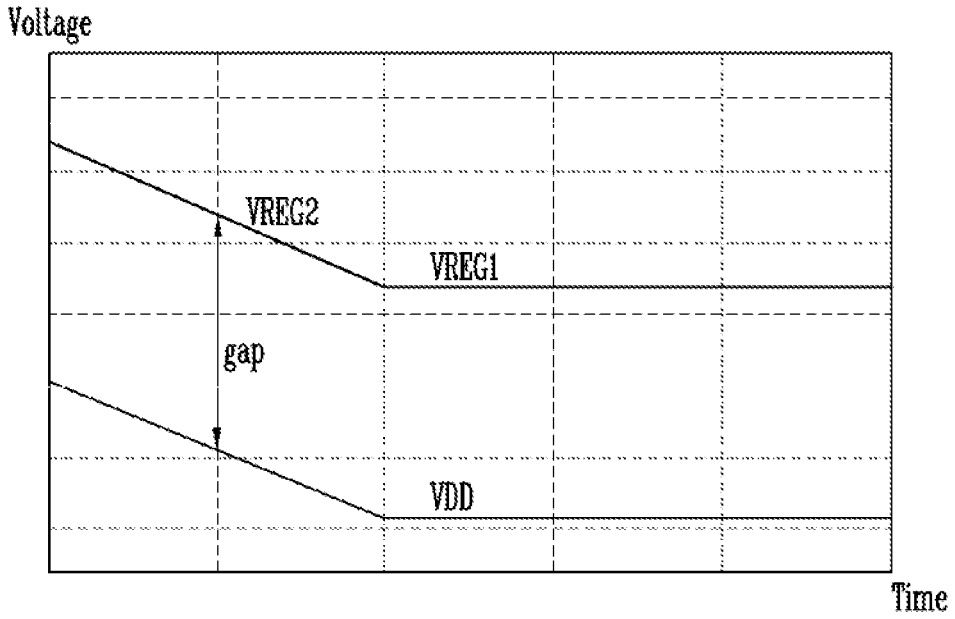
FIG. 17 is a timing diagram showing an enlarged view of A in graphs shown in FIGS. 15 and 16.

FIG. 17 is an enlarged view of A in graphs shown in FIGS. 15 and 16.

Referring to FIG. 17, A is an enlarged view of the transition period of the display mode. According to embodiments of the disclosure, even though the first power voltage VDD is reduced to further reduce power consumption in the second display mode, which is a low power display mode, the gap between the first power voltage VDD and the second gamma voltage VREG2 may be maintained during the transition period of the display mode as well as the first display mode and the second display mode. Since the gap is always maintained, the driving current flowing through the pixel PXij is also maintained to be constant, thereby preventing the luminance deviation that occurs when the display mode is changed.

Figure 18:
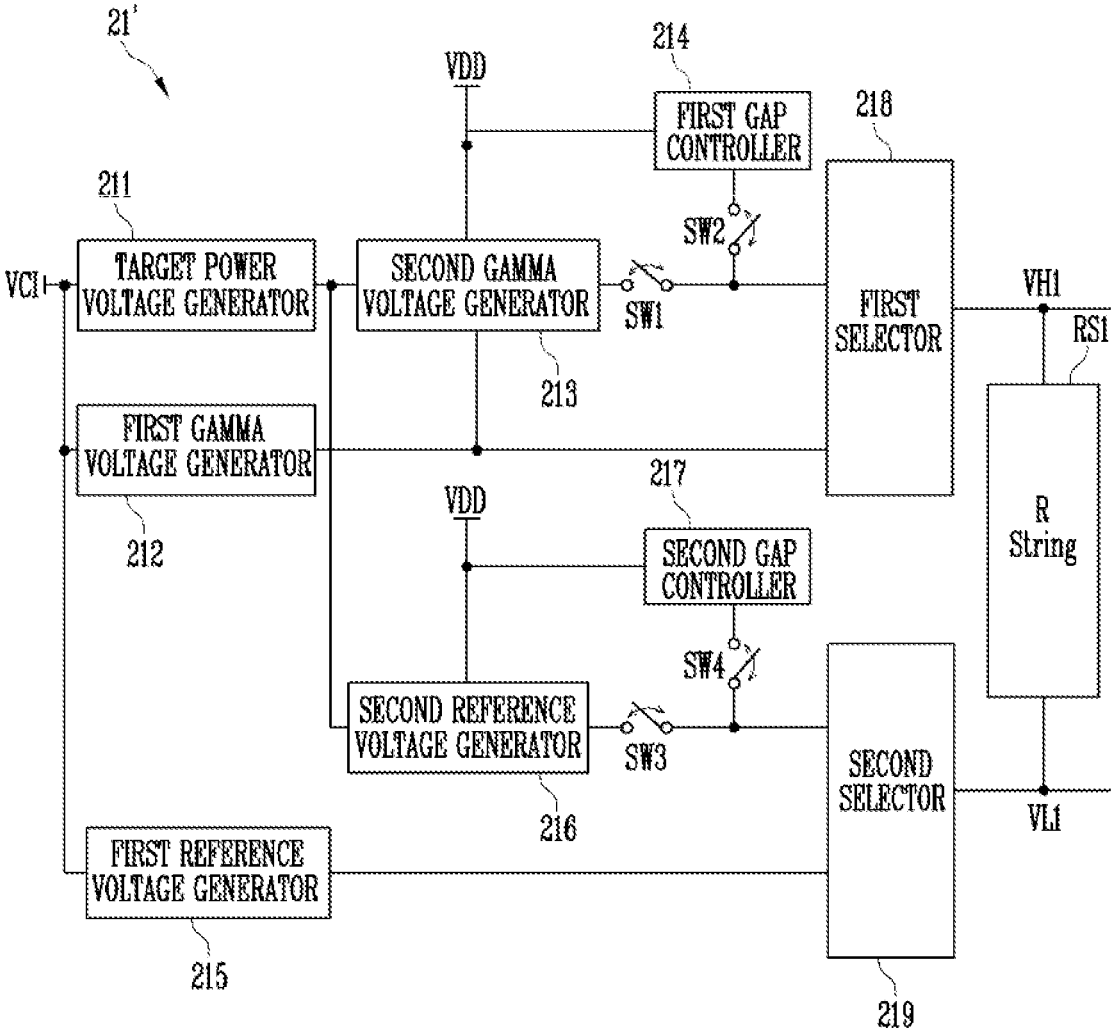
FIG. 18 is a block diagram for describing a power converter according to an embodiment of the disclosure.

FIG. 18 is a diagram for describing a power converter according to another embodiment of the disclosure.

Referring to FIG. 18, the power converter 21' according to another embodiment of the disclosure is similar to the power converter 21 shown in FIG. 10 in that the power converter 21' includes the target power voltage generator 211, the first gamma voltage generator 212, the second gamma voltage generator 213, the first gap controller 214, the first reference voltage generator 215, the second reference voltage generator 216, the second gap controller 217, the first selector 218, and the second selector 219. Therefore, description thereof is omitted below.

However, the power converter 21' shown in FIG. 17 is different from the power converter 21 shown in FIG. 10 in that the power converter 21' further includes a first switch SW1, a second switch SW2, a third switch SW3, and a fourth switch SW4.

The first switch SW1 may be closed so that the second gamma voltage generator 213 and the first selector 218 are electrically connected during the first display mode. In addition, the first switch SW1 may be opened so that the second gamma voltage generator 213 and the first selector 218 are electrically separated during the transition period in which the display mode is switched.

The second switch SW2 may be closed so that the first gap controller 214 and the first selector 218 are electrically connected during the transition period in which the display mode is switched. In addition, the second switch SW2 may be opened so that the first gap controller 214 and the first selector 218 are electrically separated during the period of the first display mode or the period of the second display mode.

The third switch SW3 may be closed so that the second reference voltage generator 216 and the second selector 219 are electrically connected during the first display mode. In addition, the first switch SW1 may be opened so that the second reference voltage generator 216 and the second selector 219 are electrically separated during the transition period in which the display mode is switched.

The fourth switch SW4 may be closed so that the second gap controller 217 and the second selector 219 are electrically connected during the transition period in which the display mode is switched. In addition, the second switch SW2 may be opened so that the second gap controller 217 and the second selector 219 are electrically separated during the period of the first display mode or the period of the second display mode.

As described above, during the transition period in which the display mode is switched, the second gamma voltage VREG2 output from each of the second gamma voltage generator 213 and the first gap controller 214 is prevented from being simultaneously input to the first selector 218, and the second reference voltage VREF2 output from each of the second reference voltage generator 216 and the second gap controller 217 is prevented from being simultaneously input to the second selector 219. Therefore, an incorrect operation may be prevented.

As described above, embodiments of the disclosure may provide a display device that minimizes a luminance deviation when the display mode is switched.

Moreover, embodiments of the disclosure may provide a display device capable of further reducing power consumption in the low power display mode.

Although exemplary embodiments of the disclosure have been described with reference to the accompanying drawings, it may be understood by those of ordinary skill in the pertinent art to which the disclosure pertains that embodiments may be implemented in other specific forms without changing the technical spirit and scope of the disclosure. Therefore, it should be understood that the embodiments described above are illustrative and are not restrictive, in all aspects.

What is claimed is:

1. A display device comprising:

a plurality of pixels;

a target power voltage generator circuit configured to generate a target power voltage corresponding to a first power voltage based on an external input voltage;

a first gamma voltage generator circuit configured to generate a first gamma voltage based on the external input voltage;

a second gamma voltage generator circuit configured to generate a second gamma voltage based on the target power voltage, the first gamma voltage, and the first power voltage;

a first gap controller configured to generate the second gamma voltage based on the first power voltage, a reference target power voltage, and a reference gamma voltage during a period in which a display mode is switched to display frames of the plurality of pixels at a different driving frequency; and a first selector configured to selectively output any one of the first gamma voltage and the second gamma voltage to a first output terminal according to the display mode.

2. The display device according to claim 1, wherein the target power voltage generator circuit comprises:

a first amplifier including a first input terminal to which the external input voltage is input, a second input terminal to which a feedback voltage of the target power voltage is input, and an output terminal from which the target power voltage is output; and a first voltage divider circuit configured to output the feedback voltage of the target power voltage to the second input terminal of the first amplifier.

3. The display device according to claim 1, wherein the first gamma voltage generator circuit comprises:

a second amplifier including a first input terminal to which the external input voltage is input, a second input terminal to which a feedback voltage of the first gamma voltage is input, and an output terminal from which the first gamma voltage is output; and a second voltage divider circuit configured to output the feedback voltage of the first gamma voltage to the second input terminal of the second amplifier.

4. The display device according to claim 1, wherein the second gamma voltage generator circuit comprises:

a first resistor including a first terminal connected to an output terminal of the target power voltage generator circuit and a second terminal connected to a first node;

a second resistor including a first terminal connected to the first node and a second terminal connected to a second node;

a third resistor including a first terminal connected to an output terminal of the first gamma voltage generator circuit and a second terminal connected to a third node;

a fourth resistor including a first terminal connected to the first power voltage and a second terminal connected to the third node; and a third amplifier including a first input terminal connected to the first node, a second input terminal connected to the third node, and an output terminal from which the second gamma voltage is output.

5. The display device according to claim 4, wherein all resistance values of the first resistor, the second resistor, the third resistor, and the fourth resistor are the same as each other, and the third amplifier outputs the second gamma voltage based on a difference value between the first power voltage and the target power voltage, and the first gamma voltage.

6. The display device according to claim 4, wherein the third amplifier is turned on during a period of a first display mode in which the plurality of pixels display frames at a first driving frequency, and is turned off during a period in which the display mode is switched between a second display mode in which the plurality of pixels display frames at a second driving frequency less than the first driving frequency, and the first display mode.

7. The display device according to claim 6, wherein the third amplifier is turned on during a period of the second display mode, or turned off during the period of the second display mode.

8. The display device according to claim 7, wherein the third amplifier is turned off after at least one frame displayed after a period in which the display mode is switched from the first display mode to the second display mode.

9. The display device according to claim 1, wherein the first gap controller generates the second gamma voltage based on a difference value between the reference target power voltage and the reference gamma voltage, and the first power voltage.

10. The display device according to claim 9, wherein the first gap controller is turned off during a period of a first display mode in which the plurality of pixels display frames at a first driving frequency or during a period of a second display mode in which the plurality of pixels display frames at a second driving frequency less than the first driving frequency, and is turned on during a period in which the display mode is switched between the first display mode and the second display mode.

11. The display device according to claim 1, wherein the first selector receives a first selection signal instructing a first display mode displaying frames at a first driving frequency or a second selection signal instructing a second display mode displaying frames at a second driving frequency less than the first driving frequency, when the first selector receives the first selection signal, the first selector outputs the second gamma voltage to the first output terminal, and when the first selector receives the second selection signal, the first selector outputs the first gamma voltage to the first output terminal.

12. The display device according to claim 11, wherein the first selector includes a multiplexer including a first input terminal connected to an output terminal of the second gamma voltage generator circuit and an output terminal of the first gap controller, a second input terminal connected to an output terminal of the first gamma voltage generator circuit, a third input terminal to which the first selection signal or the second selection signal is applied, and an output terminal from which the first gamma voltage or the second gamma voltage is output.

13. A display power converter comprising:

a first input terminal configured to receive an external input voltage;

a second input terminal configured to receive a first power voltage for a plurality of pixels;

a first output terminal configured to provide a gamma voltage for controlling the plurality of pixels;

a target power voltage generator circuit configured to generate a target power voltage corresponding to the first power voltage based on the external input voltage;

a first gamma voltage generator circuit configured to generate a first gamma voltage based on the external input voltage;

a second gamma voltage generator circuit configured to generate a second gamma voltage based on the target power voltage, the first gamma voltage, and the first power voltage;

a first gap controller configured to generate the second gamma voltage based on the first power voltage, a reference target power voltage, and a reference gamma voltage during a period in which a display mode is switched to display frames of the plurality of pixels at a different driving frequency;

a first selector configured to selectively output any one of the first gamma voltage and the second gamma voltage to the first output terminal according to the display mode;

a first reference voltage generator circuit configured to generate a first reference voltage based on the external input voltage;

a second reference voltage generator circuit configured to generate a second reference voltage based on the target power voltage, the first reference voltage, and the first power voltage;

a second gap controller configured to generate the second reference voltage based on the first power voltage, the reference target power voltage, and a reference voltage during a period in which the display mode is switched; and a second selector configured to selectively output any one of the first reference voltage and the second reference voltage to a second output terminal of the power converter according to the display mode.

14. The display power converter according to claim 13, wherein the first reference voltage generator circuit comprises:

a fourth amplifier including a first input terminal to which the external input voltage is input, a second input terminal to which a feedback voltage of the first reference voltage is input, and an output terminal from which the first reference voltage is output; and a third voltage divider circuit configured to output the feedback voltage of the first reference voltage to the second input terminal of the fourth amplifier.

15. The display power converter according to claim 13, wherein the second reference voltage generator circuit comprises:

a fifth resistor including a first terminal connected to an output terminal of the target power voltage generator circuit and a second terminal connected to a fourth node;

a sixth resistor including a first terminal connected to the fourth node and a second terminal connected to a fifth node;

a seventh resistor including a first terminal connected to an output terminal of the first reference voltage generator circuit and a second terminal connected to a sixth node;

an eighth resistor including a first terminal connected to the first power voltage and a second terminal connected to the sixth node; and a fifth amplifier including a first input terminal connected to the fourth node, a second input terminal connected to the sixth node, and an output terminal from which the second reference voltage is output.

16. The display power converter according to claim 15, wherein:

all resistance values of the fifth resistor, the sixth resistor, the seventh resistor, and the eighth resistor are the same, and the fifth amplifier outputs the second reference voltage based on a difference value between the first power voltage and the target power voltage, and the first reference voltage.

17. The display power converter according to claim 15, wherein the fifth amplifier is turned on during a period of a first display mode in which the plurality of pixels display frames at a first driving frequency, and is turned off during a period in which the display mode is switched between a second display mode in which the plurality of pixels display frames at a second driving frequency less than the first driving frequency, and the first display mode.

18. The display power converter according to claim 17, wherein the fifth amplifier is turned on during a period of the second display mode, or turned off during the period of the second display mode.

19. The display power converter according to claim 13, wherein the second gap controller generates the second reference voltage based on a difference value between the reference target power voltage and the reference voltage, and the first power voltage.

20. The display power converter according to claim 19, wherein the second gap controller is turned off during a period of a first display mode in which the plurality of pixels display frames at a first driving frequency or during a period of a second display mode in which the plurality of pixels display frames at a second driving frequency less than the first driving frequency, and is turned on during a period in which the display mode is switched between the first display mode and the second display mode.

* * * * *